US011505386B2

(12) United States Patent
Malott et al.

(10) Patent No.: US 11,505,386 B2
(45) **Date of Patent: *Nov. 22, 2022**

(54) BAG IN BOX CONTAINER

(71) Applicant: The Procter & Gamble Company, Cincinnati, OH (US)

(72) Inventors: Ian Oliver Malott, Hyde Park, OH (US); Joseph Bohache, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/103,135

(22) Filed: Nov. 24, 2020

(65) Prior Publication Data

US 2021/0078785 A1 Mar. 18, 2021

Related U.S. Application Data

(63) Continuation of application No. 16/590,736, filed on Oct. 2, 2019, now Pat. No. 10,882,677.

(60) Provisional application No. 62/749,433, filed on Oct. 23, 2018, provisional application No. 62/742,081, filed on Oct. 5, 2018.

(30) Foreign Application Priority Data

Dec. 20, 2018 (EP) ..... 18214627

(51) Int. Cl.

| | |
|---|---|
| ***B65D 77/06*** | (2006.01) |
| ***B65D 25/24*** | (2006.01) |
| ***B65D 25/30*** | (2006.01) |
| ***A47K 5/12*** | (2006.01) |
| ***B65D 77/32*** | (2006.01) |

(52) U.S. Cl.

CPC ..... *B65D 77/068* (2013.01); *A47K 5/12* (2013.01); *B65D 25/24* (2013.01); *B65D 25/30* (2013.01); *B65D 77/067* (2013.01); *B65D 77/32* (2013.01)

(58) Field of Classification Search

CPC .... B65D 77/068; B65D 25/30; B65D 77/067; B65D 77/32; B65D 25/24; A47K 5/12

See application file for complete search history.

(56) References Cited

U.S. PATENT DOCUMENTS

| | | | |
|---|---|---|---|
| 2,803,390 | A | 8/1957 | Mackay |
| 9,567,130 | B1 | 2/2017 | Drouet et al. |
| 10,882,677 | B2 | 1/2021 | Malott et al. |
| 10,919,681 | B2 | 2/2021 | Bohache et al. |

(Continued)

FOREIGN PATENT DOCUMENTS

| | | | |
|---|---|---|---|
| CH | 655702 | A5 | 5/1986 |
| DE | 8324174 | U1 | 11/1983 |

(Continued)

OTHER PUBLICATIONS

All Office Actions, U.S. Appl. No. 16/590,753.

(Continued)

*Primary Examiner* — Jeremy Carroll

(74) *Attorney, Agent, or Firm* — Gary J. Foose

(57) ABSTRACT

A bag in box container having one or more features for lifting the bag in box, deploying the tap dispenser of the bag in box conveniently, storing a dosing cup, or conveniently using the bag in box container.

16 Claims, 25 Drawing Sheets

(56) References Cited

U.S. PATENT DOCUMENTS

| | | | | |
|---|---|---|---|---|
| 11,040,815 | B2 | 6/2021 | Ficke et al. | |
| 2004/0245274 | A1 | 12/2004 | Martinez | |
| 2009/0159594 | A1 | 6/2009 | Nielsen et al. | |
| 2010/0018988 | A1 | 1/2010 | Reineccius | |
| 2011/0031303 | A1 | 2/2011 | Zink | |
| 2011/0056983 | A1 | 3/2011 | Hackleman et al. | |
| 2011/0094495 | A1 | 4/2011 | Lamensdorf | |
| 2012/0217265 | A1 | 8/2012 | Edwards | |
| 2014/0076927 | A1* | 3/2014 | Brooks | B65D 77/068 222/105 |
| 2015/0108165 | A1 | 4/2015 | Merner et al. | |
| 2018/0155106 | A1* | 6/2018 | Troxell | B65D 77/245 |
| 2018/0362238 | A1* | 12/2018 | Chen | B65D 77/068 |
| 2019/0152673 | A1 | 5/2019 | Hagihara | |
| 2019/0210860 | A1* | 7/2019 | Bourke | B65D 5/4608 |
| 2020/0108994 | A1* | 4/2020 | Bohache | B65D 77/32 |
| 2021/0078785 | A1 | 3/2021 | Malott et al. | |
| 2021/0130066 | A1 | 5/2021 | Bohache et al. | |

FOREIGN PATENT DOCUMENTS

| | | | | |
|---|---|---|---|---|
| DE | 8909888 | U1 | 12/1989 | |
| EP | 0330833 | A2 * | 9/1989 | B65D 77/24 |
| EP | 0330833 | A2 | 9/1989 | |
| EP | 0365940 | A1 | 5/1990 | |
| EP | 0420818 | A1 | 4/1991 | |
| FR | 2494228 | A2 | 5/1982 | |
| JP | S4813424 | B1 * | 4/1973 | |
| JP | S4813424 | B1 | 4/1973 | |
| JP | H06127567 | A | 5/1994 | |
| JP | 2022500323 | A | 1/2022 | |
| JP | 2022502320 | A | 1/2022 | |
| JP | 2022508481 | A | 1/2022 | |
| KR | 20110005042 | A | 1/2011 | |
| KR | 20110005042 | U | 5/2011 | |
| TW | 383738 | U | 3/2000 | |
| WO | 2007133952 | A1 | 11/2007 | |
| WO | 2011054356 | A1 | 5/2011 | |
| WO | 2011054366 | A1 | 5/2011 | |

OTHER PUBLICATIONS

All Office Actions, U.S. Appl. No. 16/590,744.

All Office Actions, U.S. Appl. No. 17/146,042.

Extended European Search Report and Search Opinion; Application No. 18214627.4; dated Apr. 10, 2019; 9 pages.

Extended European Search Report and Search Opinion; Application No. 18214658.9; dated Apr. 8, 2019; 12 pages.

Extended European Search Report and Search Opinion; Application No. 18214682.9; dated Apr. 8, 2019; 8 pages.

International Search Report and Written Opinion; Application Ser. No. PCT/US2019/054169; dated Jan. 8, 2020, 15 pages.

International Search Report and Written Opinion; Application Ser. No. PCT/US2019/054170; dated Mar. 6, 2020, 18 pages.

International Search Report and Written Opinion; Application Ser. No. PCT/US2019/054172; dated Jan. 8, 2020, 14 pages.

Extended EP Search Report and Search Opinion for 22150742.9 dated May 3, 2022, 10 pages.

* cited by examiner

BAG IN BOX CONTAINER

FIELD OF THE INVENTION

Liquid product dispensing.

BACKGROUND OF THE INVENTION

There is a continuing unaddressed need for bag in box containers for liquid dispensing that are more convenient to use than those presently available. Presently, bag in box containers that are in the mass market are inconvenient to use by consumers.

First the consumer removes some primitively designed tear off or tear out tab to create an opening in the bag in box container so that they can retrieve the tap dispenser from the interior of the bag in box container. Typically the bag in the bag in box container is just stuffed into the container and the tap dispenser is in a retracted position between folds of the bag and is difficult for the consumer to find, grasp, and extend out of the container.

Then the consumer needs to find a receptacle into which he or she can dispense the contents of the bag in box container. Often, this receptacle, for instance a cup or a wine glass, is in a place remote from where the bag in box container is or the receptacle is in a storage cabinet.

The consumer must then find a place to put the bag in box container so that he or she can dispense from the tap dispenser. Typically, the tap dispenser is near the bottom of the bag in box container so that most of the liquid contained therein can be dispensed. As such, the bag in box container cannot just simply be placed on a flat surface because the receptacle into which the liquid will be dispensed will not fit beneath the tap dispenser. So, the consumer needs to find an overhanging countertop or shelf so that he or she has room to position the receptacle beneath the tap dispenser where the bag in box container overhangs the countertop or shelf.

For bag in box containers used to dispense liquids that are measured in a dosing cup, such as cooking oil, liquid laundry detergent, liquid fabric softener, and distilled spirits, the dosing cup can be misplaced so that it is not readily available for the next use of the bag in box container.

With these limitations in mind, there is a continuing unaddressed need for a bag in box container that provides for convenient positioning of the tap dispenser in a position ready to dispense liquid and for elevating the tap dispenser so that a receptacle or a dosing cup can be easily positioned under the tap dispenser when the bag in box container, including the tap dispenser, is overlying a single flat surface. There is a further continuing an unaddressed need for a bag in box container for which the tap dispenser can easily be seated. And there is a further continuing unaddressed need for a bag in box container provided with a practical feature for storing a dispensing cup.

SUMMARY OF THE INVENTION

A bag in box container comprising: a tap dispenser engaged with the bag in box container, wherein the tap dispenser has a tap dispenser outlet through which flow can occur; a dosing cup engaged with the bag in box container, the dosing cup extending from a closed end to an open end and having a maximum height between the closed end and the open end, the maximum height measured orthogonal to the closed end; a bottom panel elevationally below the tap dispenser when the tap dispenser is in an operable position; a first leg flap positioned elevationally below the bottom panel, the first leg flap extending from a first proximal end associated with the bag in box container to a first distal end and having a first hinge line positioned between the first proximal end and the first distal end; a second leg flap positioned elevationally below the bottom panel, the second leg flap extending from a second proximal end associated with the bag in box container to a second distal end and having a second hinge line positioned between the second proximal end and the second distal end; a first discontinuity in the bottom panel positioned between the first hinge line and the first distal end and operably engageable with the first distal end when the first leg flap is folded about the first hinge line; a second discontinuity in the bottom panel positioned between the second hinge line and the second distal end and operably engageable with the second distal end when the second leg flap is folded about the second hinge line; optionally wherein when the first distal end is engaged with the first discontinuity and the second distal end is engaged with the second discontinuity a resting plane defined by the hinge lines is separated from the tap dispenser outlet by a distance greater than the maximum height.

DETAILED DESCRIPTION OF THE INVENTION

Figure 1:
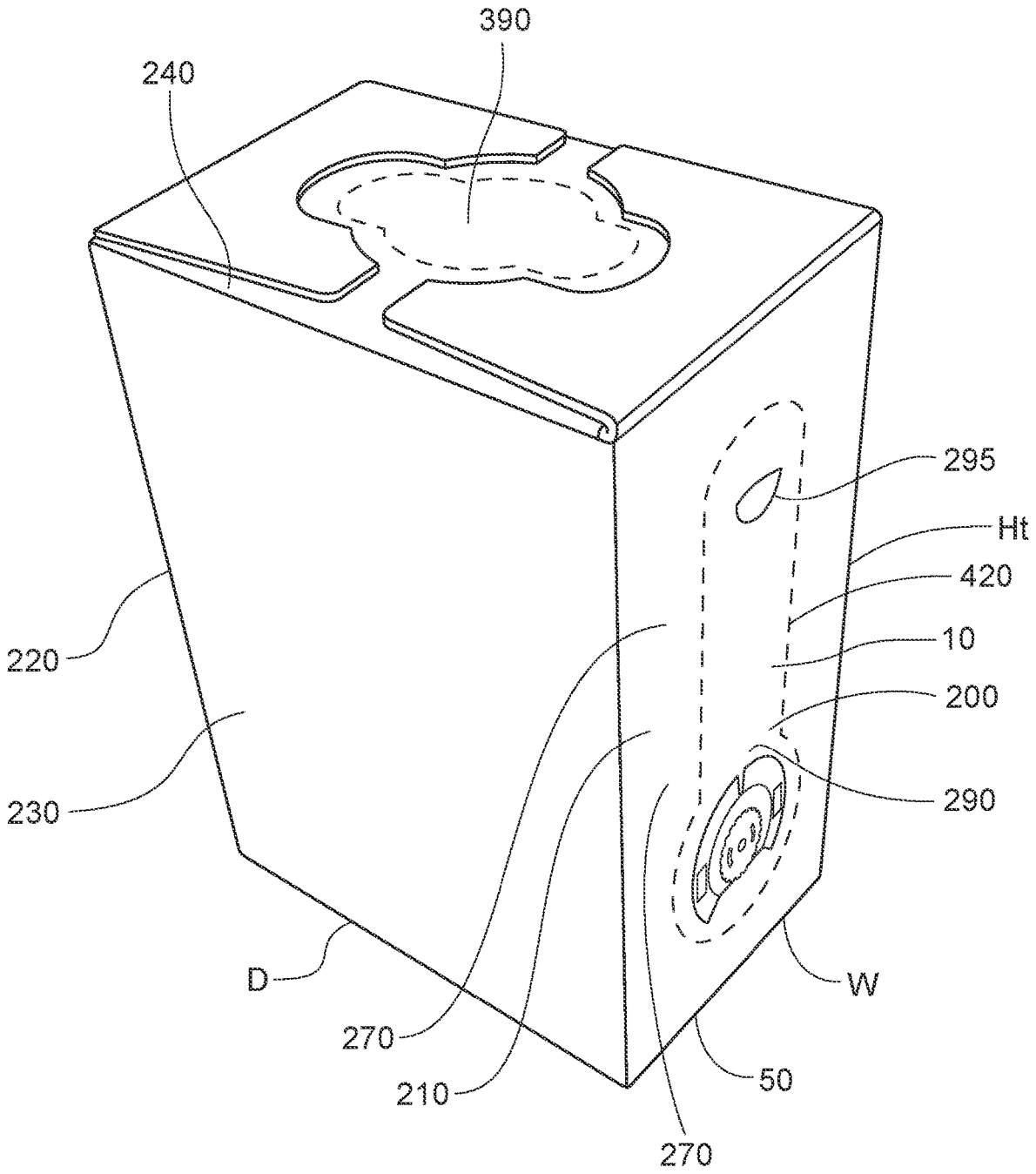
FIG. 1 is perspective view of a bag in box container.

A bag in box container 10 is shown in FIG. 1. The bag in box container 10 can be practical for delivery from the manufacturer to the consumer via a parcel delivery service. The bag in box container 10 can be conveniently shrink wrapped with a plastic sheet that is conformed to the bag in box container 10 and delivery information can be placed on the exterior of the plastic sheet. The bag in box container 10 can contain from about 0.5 L to about 30 L, optionally from about 0.5 L to about 10 L, or about 1 L to about 5 L, of liquid.

The bag in box container 10 can be a self-contained liquid delivery system that includes a flexible bag that is interior to the bag in box container 10. The flexible bag can contain a liquid. A dosing cup can also be provided as part of the bag in box container 10. The dosing cup can be interior to the bag in box container 10 or set within a recess in the exterior of the bag in box container 10. The bag in box container 10 can have various features that make the bag in box container 10 to be convenient to use.

The bag in box container 10 can be a rectangular parallelepiped. The front panel 200 can have a width W from about 50 mm to about 250 mm. The front panel 200 can have a height Ht from about 100 mm to about 500 mm. The front panel 200 is the side of the bag in box container 10 from which liquid is dispensed, i.e. the dispensing side, when the consumer uses the bag in box container 10. The bag in box container 10 can have a depth D from about 100 mm to about 300 mm, the depth being measured away from the front panel 200.

The front panel 200 can comprise a removable tear strip 290, the removal of which provides the consumer with access to the tap dispenser within bag in box container 10. The tear strip 290 can be bounded by a frangible boundary 420. The frangible boundary 420 can be provided by a series of perforations through or partially through the front panel 200. The removeable tear strip 290 can be pushed inwardly towards the interior of the bag in box container 10 to break the frangible boundary 420. Optionally, the removable tear strip 290 can be pulled away from the bag in box container 10 to remove the removable tear strip 290. A finger hole 295 can be provided in the removable tear strip or adjacent the frangible boundary 420 so that the consumer can grip the removable tear strip 290 and tear it away from the bag in box container 10. The front panel 200 can have an artistic rendering of the tap dispenser that can be disposed behind the front panel 200 to inspire the consumer to remove the removable tear strip 290.

The liquid contained in the bag in box container 10 can be selected from the group consisting of liquid laundry detergent, liquid fabric softener, wine, oil, liquid dish detergent, liquid hand soap, liquid condiments, and combinations thereof.

The bag in box container 10 can comprise a front panel 200 that is a dispensing side 210 of the bag in box container 10, a rear panel opposite the front panel 200, opposing side panels 230 connecting the front panel 200 to the rear panel, a bottom panel below the tap dispenser and a top panel 240 opposite the bottom panel. The front panel 200 can have a front panel exterior facing surface 270 and an opposing front panel interior facing surface.

The top panel 240 can comprise a predetermined removable portion 390. The predetermined removable portion can be sized and dimensioned such that when the predetermined removeable portion 390 is removed, a dosing cup holder opening is formed and the consumer can store the dosing cup in the dosing cup holder.

Figure 2:
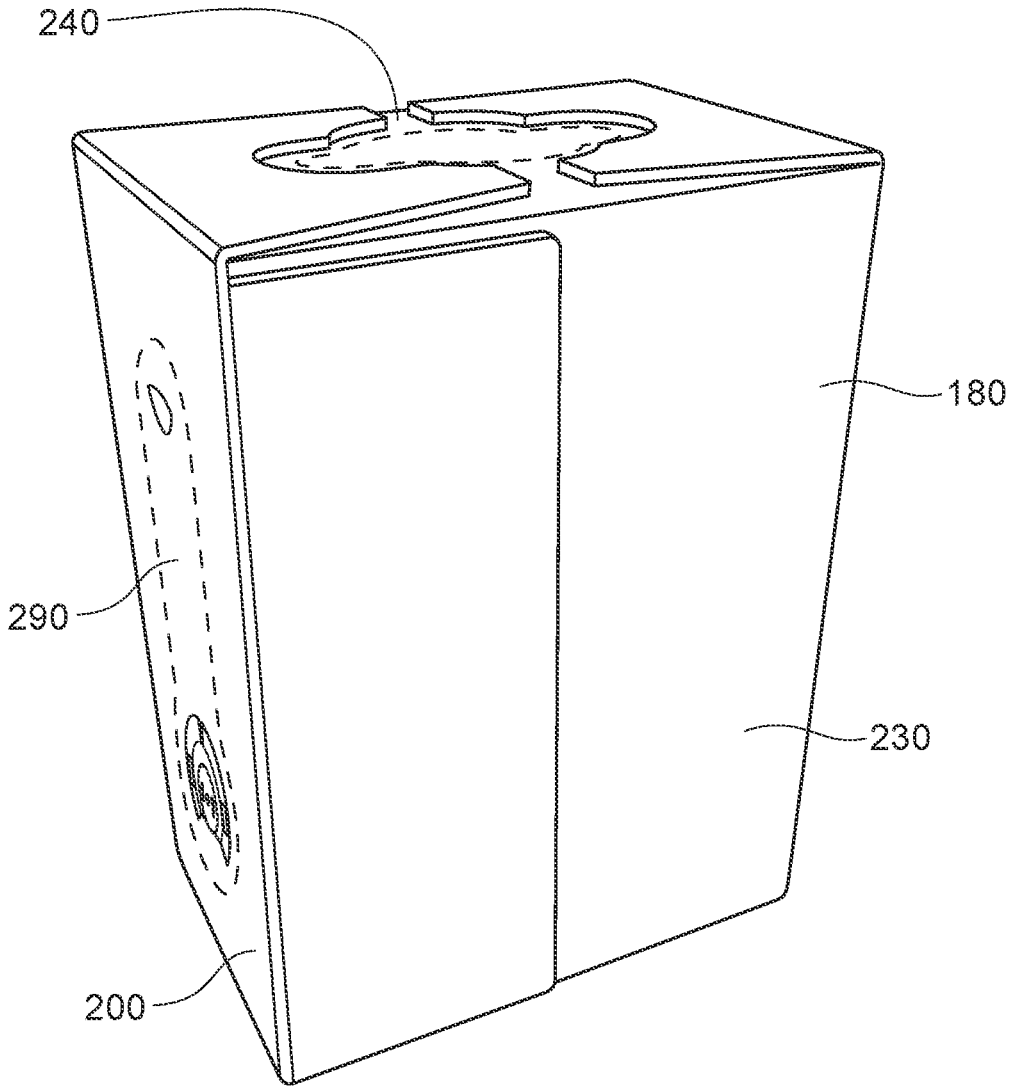
FIG. 2 is a perspective view of a bag in box container, primarily showing a side panel.

FIG. 2 is a perspective view of the bag in box container of FIG. 1 in which a side panel 230 opposite the side panel shown in FIG. 1 is shown. The panels can be formed of one or more layers of corrugate cardboard 180. Optionally, part of a panel can be formed of one layer of corrugate cardboard 180 and another part of the same panel can be formed of two, three, or more layers of corrugate cardboard 180. Multiple layers of corrugate cardboard 180 can provide for increased strength as compared to a single layer. The multiple layers can be provided at positions for which increased strength is desirable, such as near the corners or near a handle.

Figure 3:
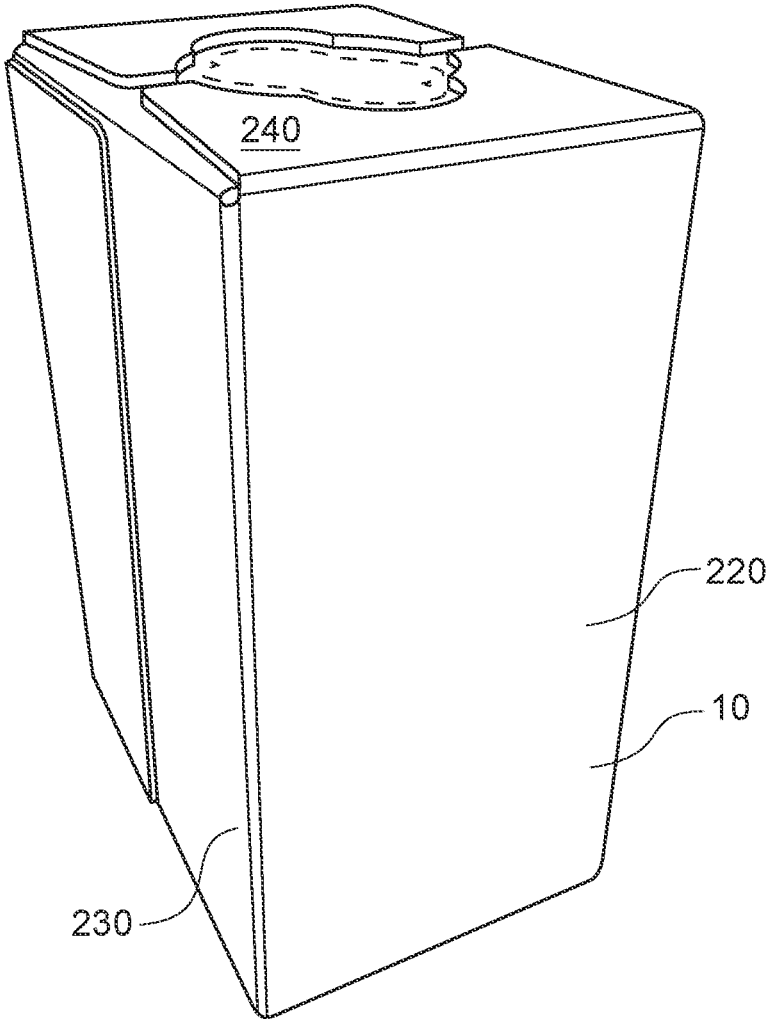
FIG. 3 is a perspective view of a bag in box container, primarily showing the rear panel.

FIG. 3 is a perspective view of the bag in box container of FIG. 1, the rear panel 220 being shown. The opposing side panels 230, front panel 200 and rear panel 220 together can connect the top panel 240 to the bottom panel 50. The opposing side panels 230, the top panel 240, and the bottom panel 50 can connect the front panel 200 to the rear panel 220. The front panel 200, rear panel 220, top panel 240 and bottom panel 50 can connect the side panels 230.

Figure 4:
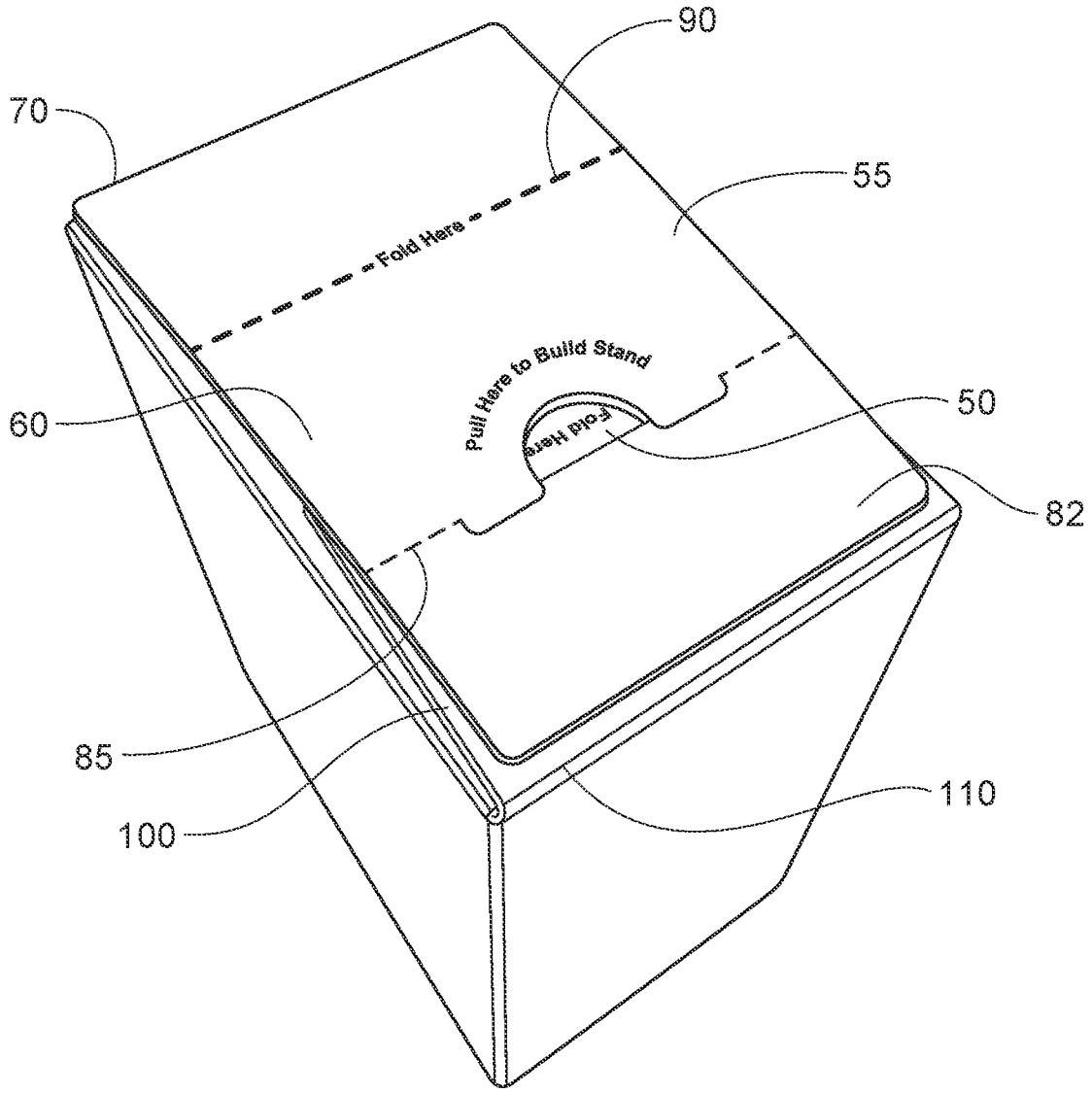
FIG. 4 is a perspective view of the bottom.

FIG. 4 is a perspective view showing the bottom 55 of the bag in box container 10. The bottom 55 can comprise structures that can be erected into a plurality of legs upon which the bag in box container 10 can stand. These legs can elevate the bag in box container 10 so that the consumer can conveniently fit a receptacle such as a cup or dosing cup beneath the tap dispenser.

The legs can be erected from a first leg flap 60 and a second leg flap 100 that is between the first leg flap 60 and the bottom panel 50. The bottom panel can extend from one of the side panels 230 or the front panel 200 or rear panel 220. The first leg flap 60 can extend from one of the side panels 230 and the second leg flap 100 can extend from the other side panel 230. Optionally, one of the first leg flap 60 or second leg flap 100 can extend from the front panel 200 and the other can extend from the rear panel 220.

The first leg flap 60 and the second leg flap 100 can be positioned elevationally below the tap dispenser so that when erected into legs, the first leg flap 60 and second leg flap 100 can raise the bag in box container 10 above a resting plane upon which the bag in box container sits, such as a countertop, table, or shelf.

The first leg flap 60 can extend from a first proximal end 70 associated with the bag in box container 10 to a first distal end. Before being erected, the first distal end can be connected to support 82 that is connected the second leg flap 100 near the second proximal end or to one of the panels to which the first distal end points. Arranged as such, the structure that forms the first leg flap 60 does not need to be directly connected to the underlying second leg flap 100 to provide for pre-erection stability. Pre-erection stability can be provided for by the first proximal end 70 being associated with the bag in box container 10 and the first distal end being connected to support 82 which is connected to the second leg flap 100 near the second proximal end or to one of the panels to which the first distal end points. Optionally, the first leg flap 60 can be removably connected to second leg flap 100, for example by using a releasable adhesive.

The first leg flap 60 can have a first hinge line 90 positioned between the first proximal end 70 and the first distal end 80. The first distal end 80 can be connected to support 82 at the first distal end 80 by a frangible line of weakness 85.

Figure 5:
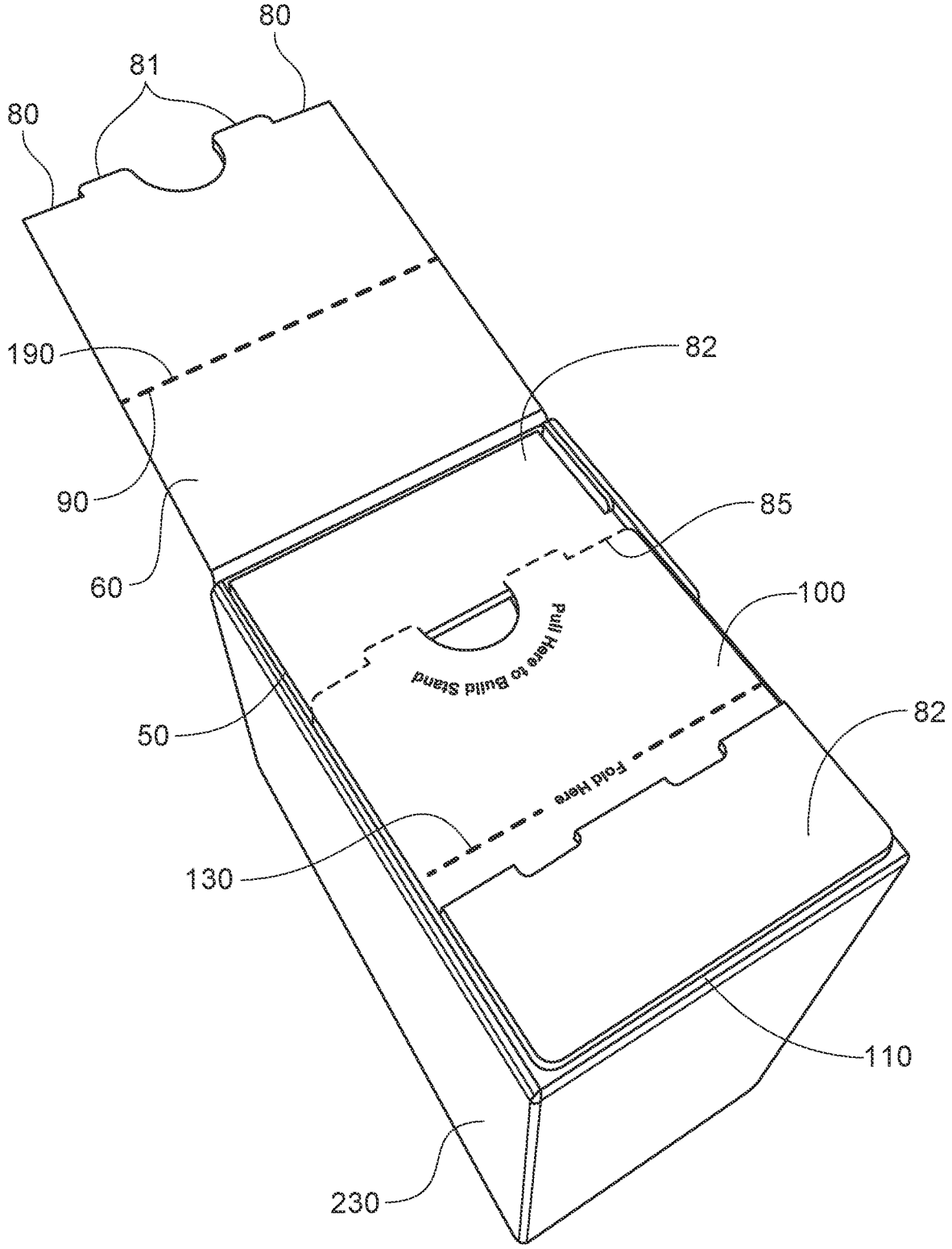
FIG. 5 is a perspective view of a bag in box container, primarily showing the bottom.

The consumer can start to erect the first leg flap by moving the first distal end 80 in a direction away from the underlying second leg flap 100, as shown in FIG. 5, which shows the first leg flap 60 opened up and the first distal end 80 being separated from support 82 or otherwise freely extending. The first distal end 80 can comprise one or more first tabs 81 extending from the first distal end 80. The first tabs 81 can be extensions of the first leg flap 60 or structure connected to the first distal end 80. The first leg flap 100 can extend from front panel 200. The first proximal end 70 can be associated with or extend from the front panel 200.

In FIG. 5, the second leg flap 100 is revealed and can be structured the same as the first leg flap 60 in pertinent part. The second leg flap 100 can extend from a second proximal end 110 associated with the bag in box container 10 to a second distal end. Before being erected, the second distal end can be connected to support 82 that can be connected to the bottom panel 50. The structure that forms the second leg flap 100 does not need to be directly connected to the underlying bottom panel 50 to provide for pre-erection stability. Pre-erection stability can be provided for by the second proximal end 110 being associated with the bag in box container 10 and the second distal end being connected to support 82 which is connect to the bottom panel 50 near the first proximal end 70 of the first leg flap 60. Optionally, the second leg flap 100 can be removably connected to the bottom panel 50, for example by using a releasable adhesive.

The second leg flap 100 can have a second hinge line 130 positioned between the second proximal end 110 and the second distal end 120. The second distal end 120 can be connected to support 82 at the second distal end 120 by a frangible line of weakness 85.

The first hinge line 90 and second hinge line 130 can be a line of weakness in the respective leg flap. The hinge lines can be a crease line 190, intermittent crease line, a perforated line, a die cut line partially penetrating the respective leg flap, intermittent die cut line partially penetrating the respective leg flap, or similar structure or combination of such structures across or partially across the respective leg flap. The structure for forming the hinge lines can be on a surface of the respective leg flap oriented towards the interior space 360.

For convenience of manufacture and erection the supports 82 can be extensions of the leg flaps and die cuts can be between the respective leg flap and the respective support 82. The supports can be the structure by which the bag in box container 10 is provided with stability upon erection. For instance, prior to deployment of the leg flaps, the support 82 that extends from the second leg flap 100 can be adhered to the bottom panel 50. And the support 82 that extends from the first leg flap 60 can be adhered to the second leg flap 100. Together, this arrangement can provide for structural stability to the bottom of the bag in box container 10.

Figure 6:
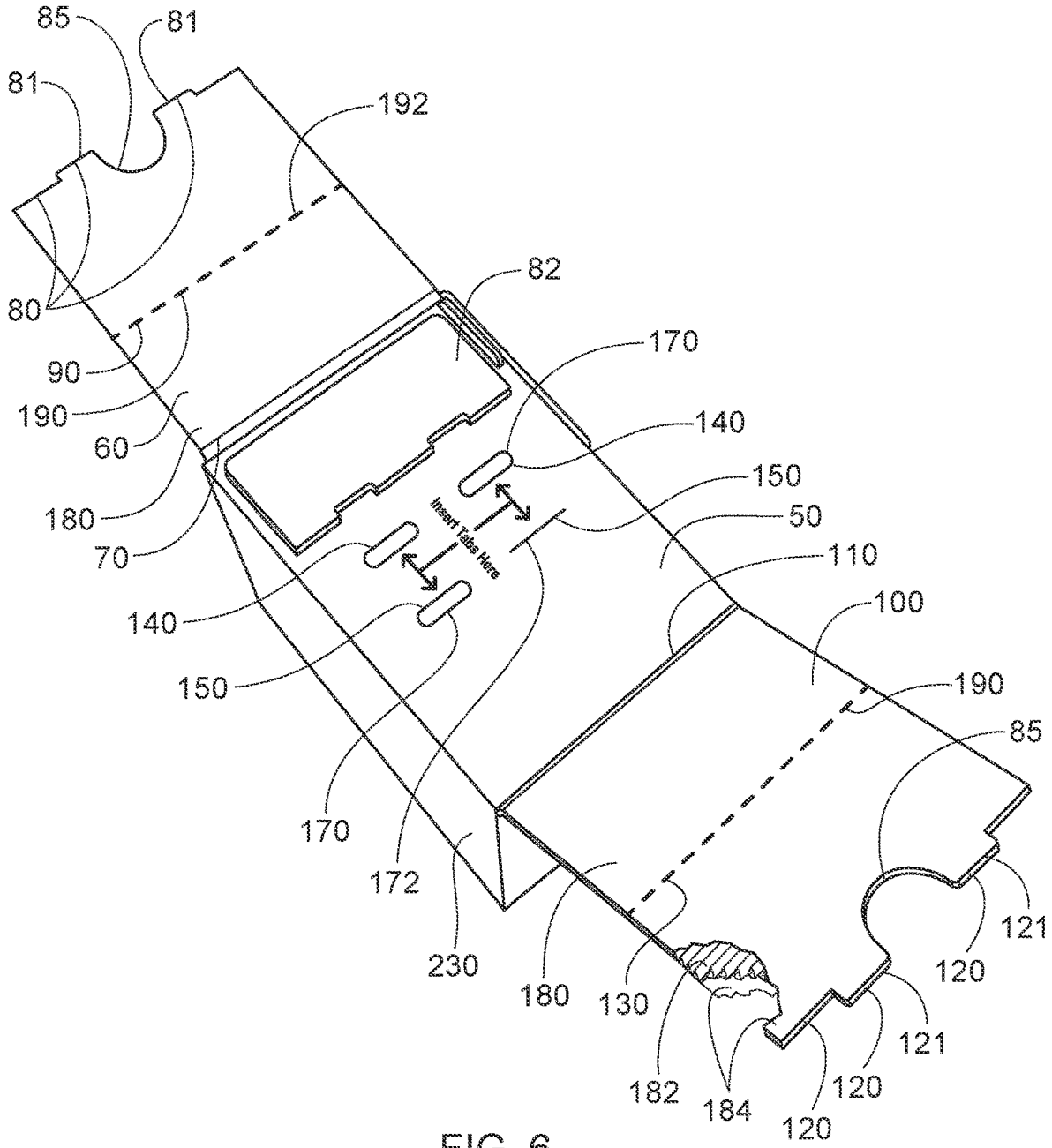
FIG. 6 is a perspective view of a bag in box container, primarily showing the bottom. The first leg flap and second leg flap are opened away from the bottom panel. Also visible are the first discontinuity and second discontinuity.

The consumer can start to erect the second leg flap 100 by moving the first distal end 80 in a direction away from the underlying second leg flap 100, as shown in FIG. 6, which shows the second leg flap 100 opened up and the second distal end 120 being separated from support 82. The second distal end 120 can comprise one or more second tabs 121 extending from the second distal end 120. The second tabs 121 can be extensions of the second leg flap 100 or structure connected to the second distal end 120. The second leg flap can extend from the rear panel 220. The second proximal end 110 can be associated with or extend from the rear panel 220. In FIG. 6, a slit 172 is illustrated as the second discontinuity 150. Optionally, any, some, or all of the first discontinuities 140 and or second discontinuities 150 can be a slit 172 or slot 170 or other structure, such as a recess, with which the distal ends of the leg flaps can engage.

The leg flaps can comprise a recessed contour 85 along one or both distal ends. The recessed contour 85 can be sized and dimensioned to fit with an adult human thumb. The recessed contours 85 can enable the consumer to easily apply force to bend the leg flaps about the hinge lines as the bag in box container 5 is deployed. The recessed contours 85 can also provide a convenient location for the consumer to pull on the leg flaps to transition the leg flaps from an as shipped condition to a deployed condition in which the leg flaps are formed into legs.

Before the first leg flap 60 is opened, the bottom panel 50 can comprise one or more first discontinuities 140 positioned between the first hinge line 90 and the first distal end 80, or optionally the one or more first tabs 81 if present, can be operably engageable with the first discontinuities 140 when the first leg flap 60 is folded about the first hinge line 90. First discontinuities 140 can be positioned nearer to the first proximal end 70 of the first leg flap 60 than to the second proximal end 110 of the second leg flap 100.

Before the second leg flap 100 is opened, the bottom panel 50 can comprise one or more second discontinuities 150 positioned between the second hinge line 130 and the second distal end 120, or optionally the one or more second tabs 121 if present, can be operably engageable with the second discontinuities 150 when the second leg flap 100 is folded about the second hinge line 130. Second discontinuities 150 can be positioned nearer to the second proximal end 110 of the second leg flap 100 than to the first proximal end 70 of the first leg flap 60.

The first discontinuities 140 and second discontinuities 150 can be selected from the group consisting of a slot 170, a slit 172, a recess, and combinations thereof. A slit 172 is a discontinuity in a material from which material is not removed. A recess is a depression in a material. A slot 170 is an aperture in a material. Discontinuities can be sized and dimensioned to receive the distal end of the respective flap or one or more tabs extending from such distal ends.

The first tab 81 can be sized and dimensioned to fit into or with the first discontinuity 140. The second tab 121 can be sized and dimensioned to fit into or with the second discontinuity 150. If there is more than one tab on a distal end, then there can be more than one discontinuity into or with which the tab can fit.

The panels and leg flaps can be comprised of corrugate cardboard 180. Corrugate cardboard 180 can comprise flutes 182 between two layers of paperboard 184. The first hinge 90 and the second hinge line 130 can be aligned with the flutes 182. The flaps can be easily folded about the hinge lines when the flutes 182 are arranged as such. The blank for the bag in box container 10 can be laid out so that when erected, the flutes 182 are arranged in the desired direction. Corrugate cardboard 180 has a greater bending strength in the direction of alignment of the flutes 182 as compared to the bending strength orthogonal to the flutes. Since the legs that are ultimately erected need to have enough bending strength such that they will not buckle under the load of the bag within the bag in box container 10, the corrugate cardboard 180 can be selected to have sufficient bending strength in relevant bending directions. The first hinge 90 and the second hinge line 130 can be orthogonal with the flutes 182. To make the legs easy to bend about the hinge lines, the corrugate cardboard 180 can be more severely structurally disrupted along the hinge line, for example by a deeper crease or die cut line or the like.

The designer can plan out the blank from which the bag in box container 10 is constructed so that the flutes 182 are aligned in the desired direction on different panels, flaps, and other appurtenances. Further, the bag in box container 10 can be constructed from a single cut piece of corrugate cardboard 180. That is, the panels and flaps can be formed from an integral piece of corrugate cardboard 180. The bottom panel 50, the first leg flap 60 and the second leg flap 100 can be integral with one another in that they are contiguous with one another through a common panel or multiple contiguous common panels. This is in contrast to separate pieces being assembled together to construct the bag in box container 10.

Figure 7:
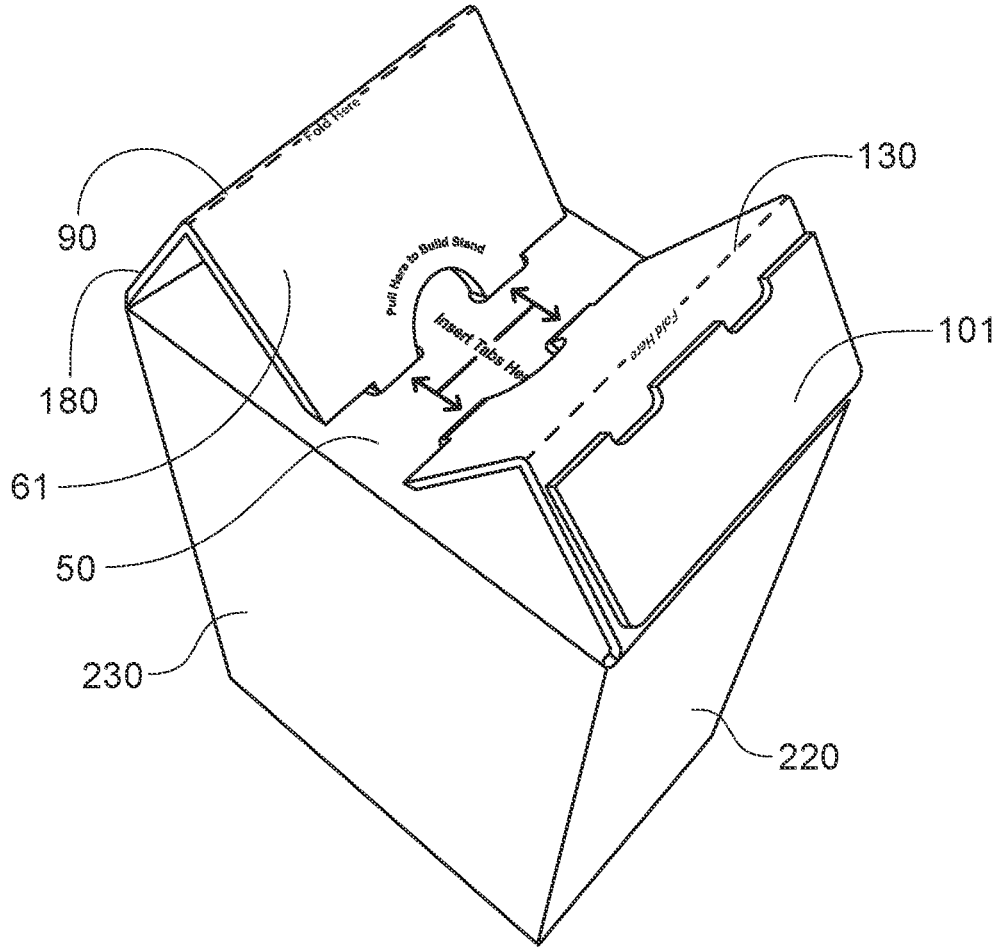
FIG. 7 is a perspective view, primarily showing the bottom.

As shown in FIG. 7, the first leg 61 and second leg 101 can be assembled by bending the respective leg flap about the respective hinge line and inserting the respective distal end, or respective tabs, into the respective discontinuities. When assembled, the first leg 61 extends from the first proximal end 70 to the first hinge line 90, is bent about the first hinge line 90, and the first distal end 80, or first tab or tabs 81, are inserted into the first discontinuity 140 or first discontinuities 140. Likewise, when assembled, the second leg 101 extends from the second proximal end 110 to the second hinge line 130, is bent about the second hinge line 130, and the second distal end 120, or second tab or tabs 121, are inserted into the second discontinuity 150 or second discontinuities 150.

Figure 8:
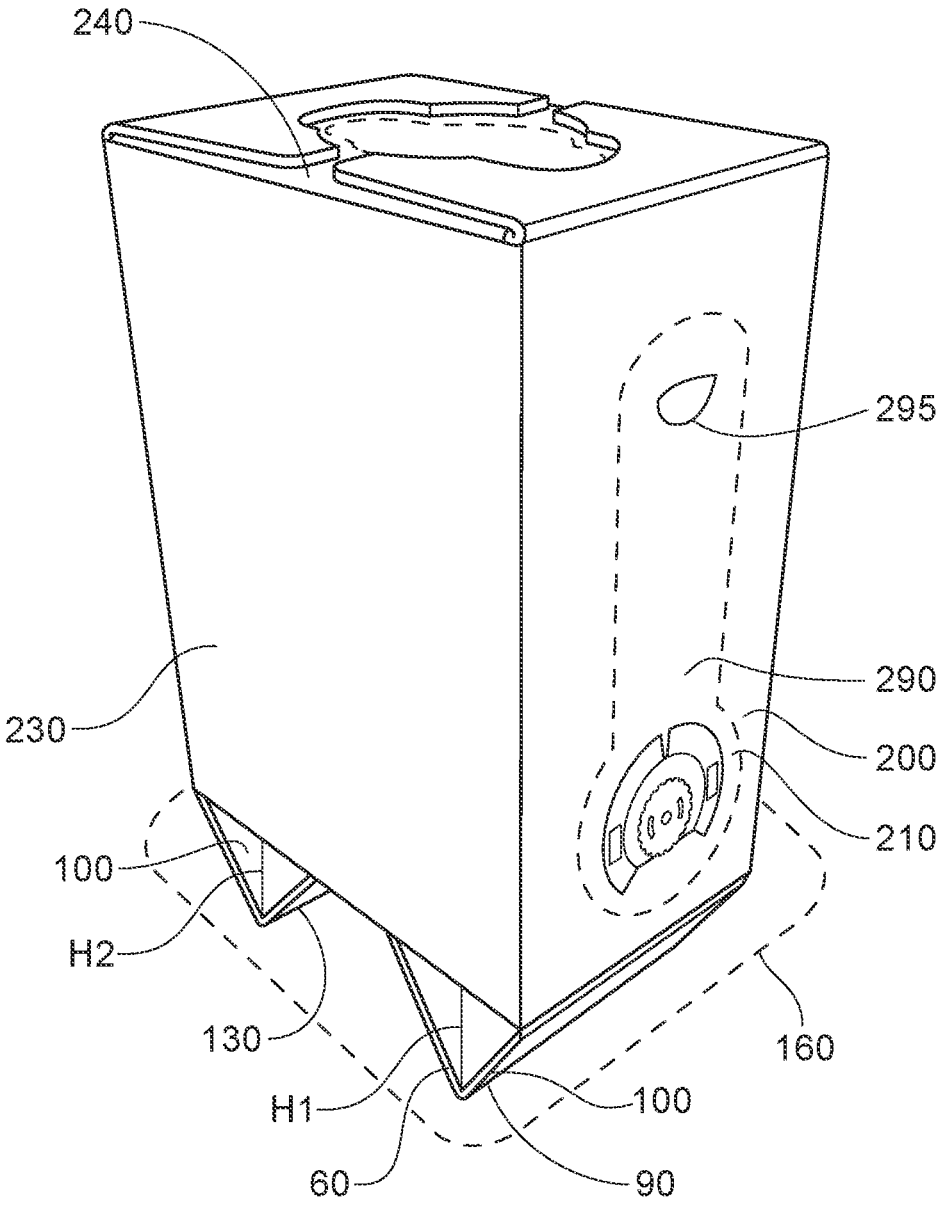
FIG. 8 is a perspective view. The bag in box container is resting on the first hinge line and the second hinge line on a flat surface.

Conveniently, the bag in box container 10 can stand on the first leg 61 and the second leg 101 to lift the bag in box container 10 above a surface upon which the bag in box container 10 rests, as shown in FIG. 8. When the first distal end 80 is engaged with the first discontinuity 140 and the second distal end 120 is engaged with the second discontinuity 150 a resting plane 160 is defined by the first hinge line 90 and the second hinge line 130 and is separated from the tap dispenser outlet by a distance greater than the maximum height H of the dosing cup 30. The resting plane 160 is a plane in which both the first hinge line 90 and the second hinge line 130 lie. The resting plane 160, being a plane, extends infinitely in two dimensions. When the bag in box container 10 is in use for dispensing liquid, the resting plane 160 is coincident with the surface upon which the legs are standing. The resting plane 160 extends outwardly to be beneath the tap dispenser outlet and the distance between the resting plane 160 and the tap dispenser outlet is measured orthogonal to the resting plane 160.

When the first distal end 80 is engaged with the first discontinuity 140 and the second distal end 120 is engaged with the second discontinuity 150, the bottom panel 50 can be spaced apart from the first hinge line 90 and the second hinge line 130 by an equal distance. This can be descriptive of the bottom panel 50 being level when the legs are resting on a level surface. This can provide for more stable situation with respect to tipping in the front to back direction as compared to if the base panel 50 is not level.

The first leg flap 60 can have a first lift height HE The first lift height H1 is the distance from the first hinge line 90 to the bottom panel 50 when the first distal end 80 is engaged with the first discontinuity 140. That is, the first lift height H1 is distance of lift provided by the first leg 61. Similarly, the second leg flap 100 can have a second lift height H2. The second lift height H2 is the distance from the second hinge line 130 to the bottom panel 50 when the second distal end 120 is engaged with the second discontinuity 150. The second lift height H2 is the distance of lift provided by the second leg 101. The first lift height H1 can be equal to the second lift height H2 to provide for stability to the bag in box container 10 in a deployed condition.

Figure 9:
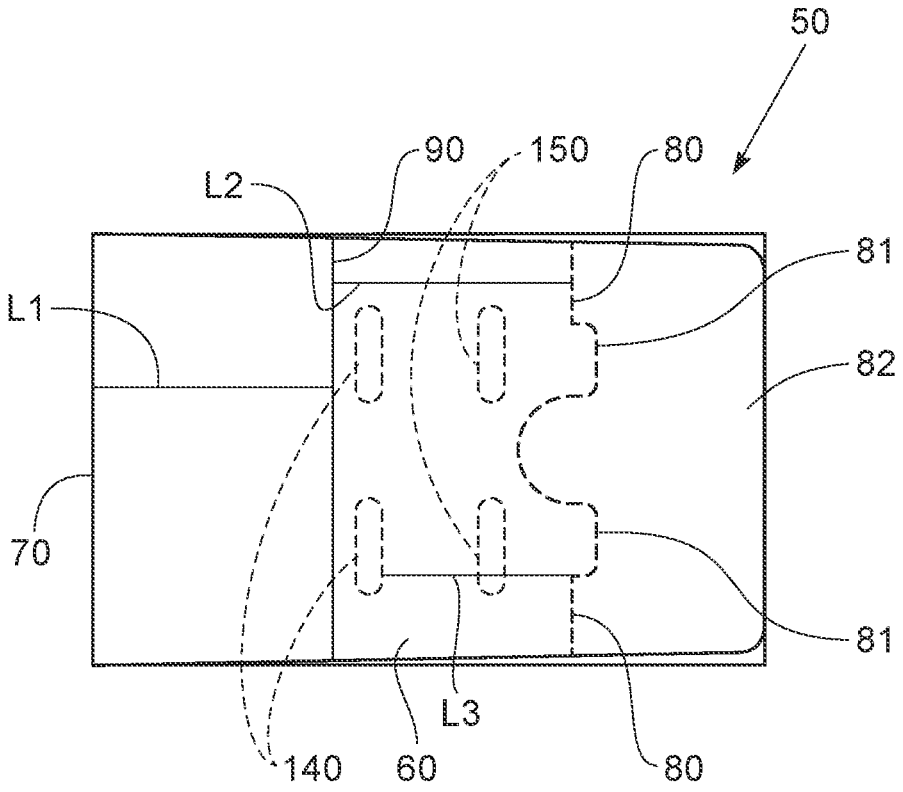
FIG. 9 is a bottom view in which the first flap is visible.

The flaps can be folded about the hinge lines to form triangular legs. The geometry of the flaps, location of the hinge lines on the flaps, and the location of the discontinuities can define the shape that the legs take and the height to which the bottom panel is lifted above the resting plane 160. The first hinge line 90 can be a distance of L1 from the first proximal end 70, as shown in FIG. 9. The first distal end 80 can be a distance of L2 from the first hinge line 90. The first discontinuity 140 can be a distance of L3 from the first distal end 80 as measured when the first flap 60 is facing the bottom panel 50. L3 can be greater than or equal to $L1+L2-(L1^2-H1^2)^{1/2}-(L2^2-H1^2)^{1/2}$ and said first discontinuity 140 can be located at a distance L1+L2−L3 from the first proximal end 70 as measured to the part of the first discontinuity 140 furthest away from the first proximal end 70.

Figure 10:
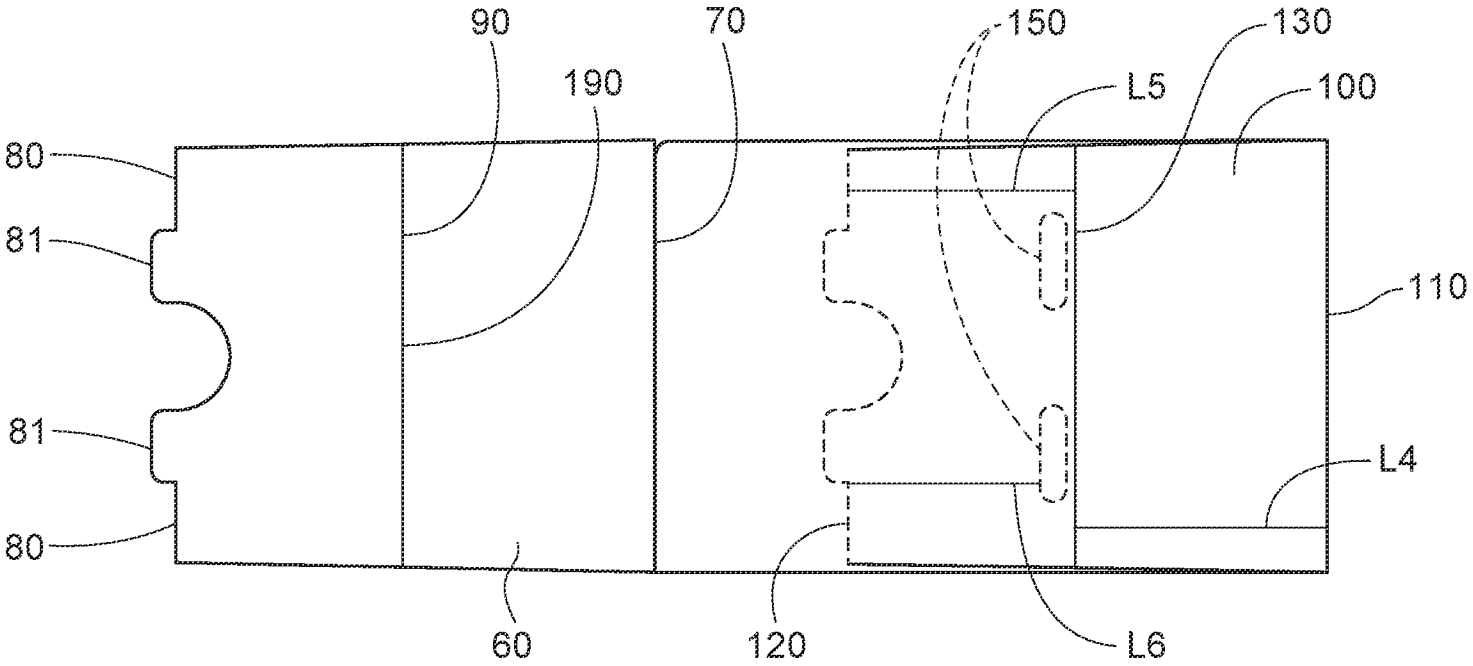
FIG. 10 is a bottom view in which the second flap is visible.

The second hinge line 130 can be a distance of L4 from the second proximal end 120, as shown in FIG. 10. The second distal end 120 can be a distance L5 from the second hinge line 130. The second discontinuity 150 can be a distance L6 from the second distal end 120 as measured when the second flap 100 is facing the bottom panel 50. L6 can be greater than or equal to $L4+L5-(L4^2-H2^2)^{1/2}-(L5^2-H2^2)^{1/2}$ and the second discontinuity 150 can be located at a distance L4+L5−L6 from the second proximal end 120 as measured to the part of the second discontinuity 150 furthest away from the second proximal end 110.

To make the desired leg structure, $L1^2$ can be greater than $H1^2$ and $L4^2$ can be greater than $H2^2$. This constraint means that H1 and H2 should not exceed L1 and L4 respectively. L1 and L4 can desirably be equal to one another. And L2 and L5 can desirably be equal to one another. And L3 and L6 can desirably be equal to one another. One or more equal corresponding lengths allows for the constructed legs to have the same geometry and simplifies construction by the consumer.

Figure 11:
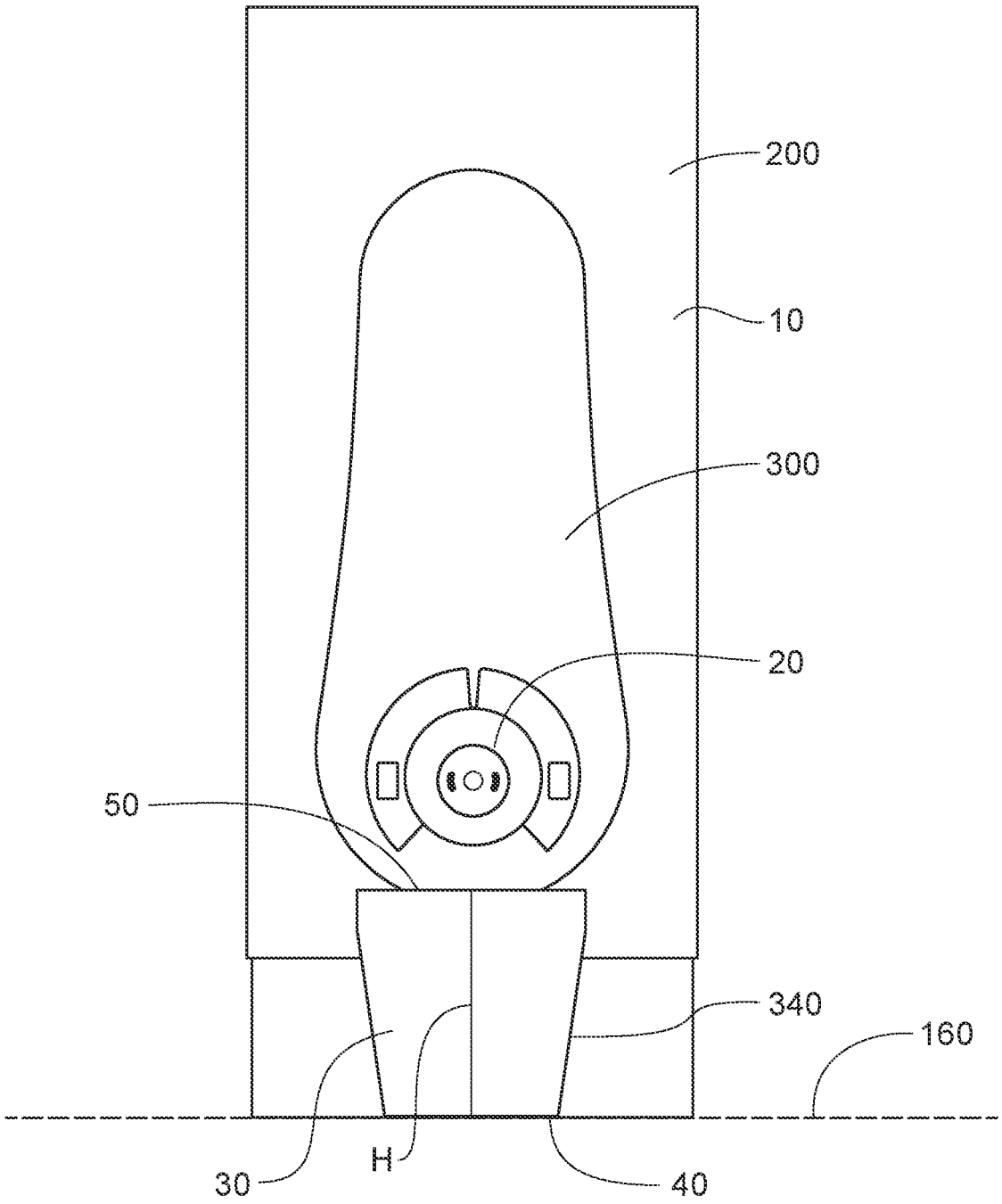
FIG. 11 is a front view.

A front view of a bag in box container 10 is shown in FIG. 11. The removable tear strip 290 is removed and the seating panel 300 is revealed. A tap dispenser 20 can be engaged with the bag in box container 10. The tap dispenser 20 can have an outlet through which flow can occur. The bag in box container can comprise a dosing cup 30 engaged with the bag in box container 10, by way of nonlimiting example interior to the bag in box container 10. The dosing cup 30 can extend from a closed end 40 to an open end 52 and have a maximum height H between the closed end 40 and the open end 52, the maximum height H measured orthogonal to the closed end 40. The dosing cup can have a peripheral wall 340 extending from the closed end 40 to the open end 52.

H1 and H2 can be equal to one another and greater than about 50% of the maximum height H of the dosing cup 30. Such arrangement can sufficiently raise the bag in box container 10 above the surface upon which the legs sit. In terms of the resting plane 160, the resting plane 160 can be separated from the tap dispenser outlet by a distance ranging from about 110% of the maximum height H to about 200% of the maximum height H, or even from about 110% of the maximum height H to about 170% of the maximum height H. The elevation of the bag in box container 10 can be stated in terms of the tap dispenser outlet. When the flaps are constructed into legs, the first hinge line 90 and the second hinge line 130 can both lie in the resting plane 160 that extends to beneath the tap dispenser and tap dispenser outlet is more than 100% of the maximum height H above the resting plane 160. The tap dispenser outlet can be more than 100% of the maximum height H above the resting plane 160. The resting plane 160 can be separated from the tap dispenser outlet 25 by a distance of more than about 110% of the maximum height H. The tap dispenser outlet can be more than about 110%, or optionally from about 110% to about 200%, optionally from about 110% to about 170%, of the maximum height H above the resting plane 160. The tap dispenser 20 can have an installed position that projects beyond the bottom panel 50 and in the installed position, the tap dispenser 20 can be more than about 110%, optionally from about 110% to about 200%, of the maximum height H above the resting plane 160. These configurations can lift the bag in box container 10 sufficiently so that the dosing cup 30 can be easily fit under the tap dispenser 20 but not so high that there is a likelihood that liquid will splash from the dosing cup 30 when liquid is dispensed into the dosing cup 30. Further, over elevating the bag in box container 10 may increase the potential for tipping.

Figure 12:
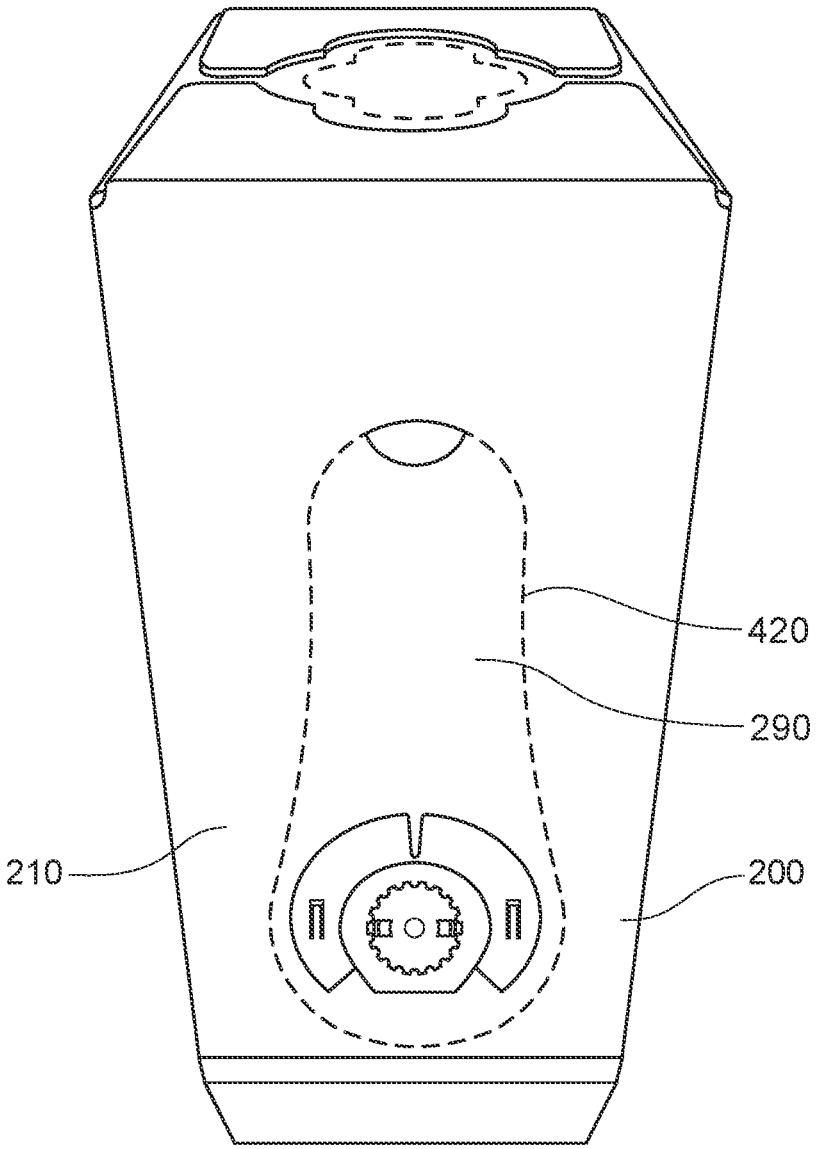
FIG. 12 is a perspective view.

The bag in box container 10 can comprise a removable tear strip 290 in the front panel 200 at least partially covering the tap dispenser 20, as shown in FIG. 12. The tear strip 290 can be removed from the bag in box container 10 to access the tap dispenser 20 that is interior to the bag in box container 10 before the tear strip 290 is removed and the tap dispenser 20 is seated and ready for dispensing. The removeable tear strip 290 can be bounded by a frangible boundary 420. The frangible boundary 420 can be a die cut, intermittent die cut, perforated line or similar structure that can be torn or punched or pulled out by the consumer.

Figure 13:
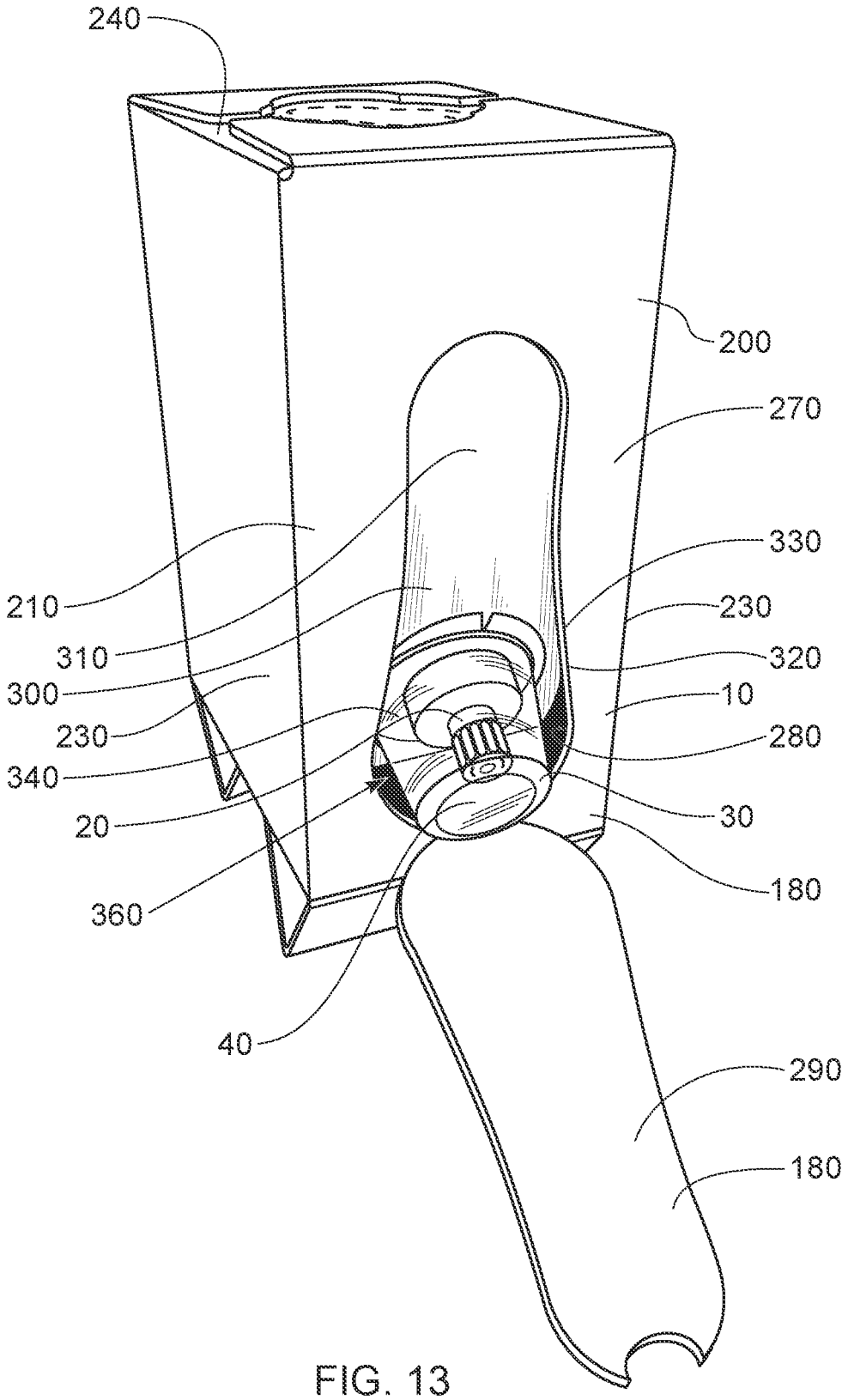
FIG. 13 is a perspective view, primarily showing the front panel. The removable tear strip is partially removed from the front panel. The tap dispenser and dosing cup are partially deployed.

Interior to the front panel 200, there can be a tap dispenser seating panel 300, as shown in FIG. 13. The tap dispenser seating panel 300 can have an upper part 310 facing the front panel 200, optionally proximal the top panel 240, and a movable bottom part 320 with which the tap dispenser 20 is engaged. Engaging the tap dispenser 20 with the bottom part 320 of the tap dispenser seating panel 300 can make it easier for the consumer to retrieve the tap dispenser 20 from the interior space 360 compared to similar bag in box executions in which the tap dispenser is just stuffed in the bag in box container 10 and might be covered by or embedded in folds of the bag in an uncontrolled manner that differs from container to container. The consumer then has to reach with his or her fingers through a small opening in the container to try to find and retrieve the tap dispenser 20. In an optional arrangement, the static pressure of the liquid in the bag can drive movement of the movable bottom part 320 towards the front panel interior facing surface to seat the tap dispenser 20 so that it is ready for use once the removable tear strip 290 is removed.

A dosing cup 30 can be housed in an interior space 360 of the bag in box container 10. The interior space 360 can be defined by the front panel 200, the rear panel 220, the side panels 230, the top panel 240, and the bottom panel 50. When the moveable bottom part 320 is in in a first position in which the tap dispenser 20 is in the interior space 360 of the bag in box container 10, at least a portion of the tap dispenser 20 can be within the dosing cup 30. Conveniently, the open end 52 of the dosing cup 30 can be fitted over the tap dispenser 20 or even snapped onto the tap dispenser 20. Such an arrangement can provide for space efficient packing of the elements.

The moveable bottom part 320 can have a first position away from the front panel interior facing surface when the removable tear strip 290 is separated from the front panel 200. Before the bag in box container 10 is deployed, for example during shipment or display on a shelf at a retailer, the tap dispenser 20 and dosing cup 30 can be housed in the interior space 360 and thereby protected during shipment or display. Upon removing the tear strip 290, the tap dispenser 20 and dosing cup 30 can be revealed.

Once the removable tear strip 290 is removed, the movable bottom part 320 of the tap dispenser seating panel 300 can move or be moved into a second position in which the movable bottom part 320 is facing the front panel interior facing surface. When the movable bottom part 320 is in the second position the tap dispenser 20 can project beyond the front panel exterior facing surface 270 through an opening 330 defined by the removable tear strip 290.

The upper part 310 can be engaged with or extend from or be integral with a panel selected from the group consisting of the top panel 240, one or both side panels 230, the front panel 200, and combinations thereof. The upper part 310 can extend from a side panel 230.

Figure 14:
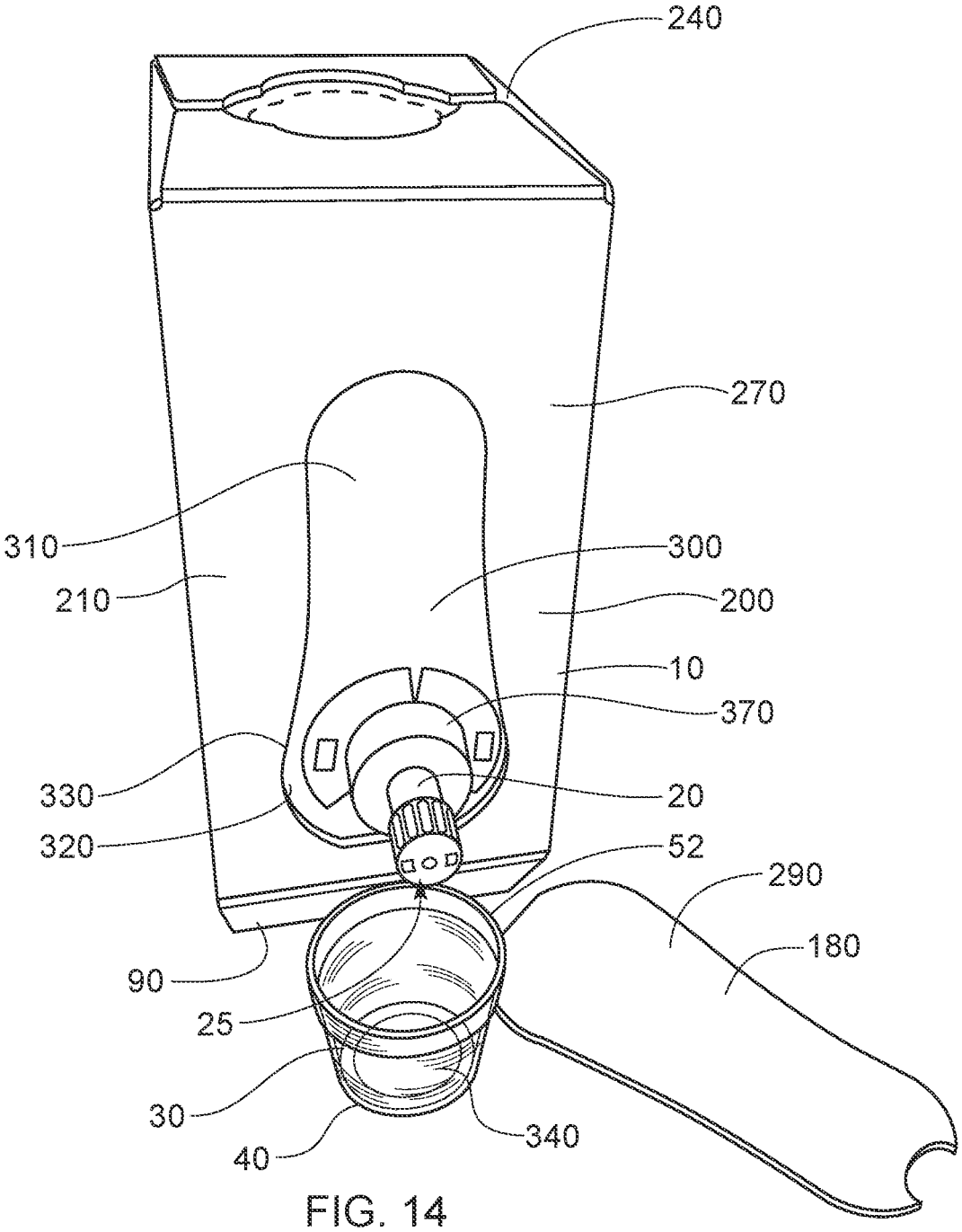
FIG. 14 is a perspective view, primarily showing the front panel. The tap dispenser is fully deployed. The dosing cup is resting on its closed end.

In FIG. 13, the moveable bottom part 320 is almost in the first position. Removal of the removable tear strip 290 has allowed the moveable bottom part 320 to move slightly towards its second position. In FIG. 14, the moveable bottom part 320 is in the second position. The tap dispenser seating panel 300 can be paper board or corrugate cardboard 180 or other material having a stiffness such that the panel 300 is able to bend or flex, particularly so that the moveable bottom part 320 can move from the first position to the second position.

The process for deploying the bag in box container 10 disclosed herein can comprise multiple steps. A step can be orienting the bottom panel 50 so that the top panel 240 is positioned above the bottom panel 50. A step can be removing the removable tear strip 290 from the front panel 200. A step can be moving the moveable bottom part 320 from the first position to the second position. Further, the dosing cup 30 can be placed beneath the tap dispenser 20. Further, liquid can be dispensed from the bag in box container 10 into the dosing cup 30.

Figure 15:
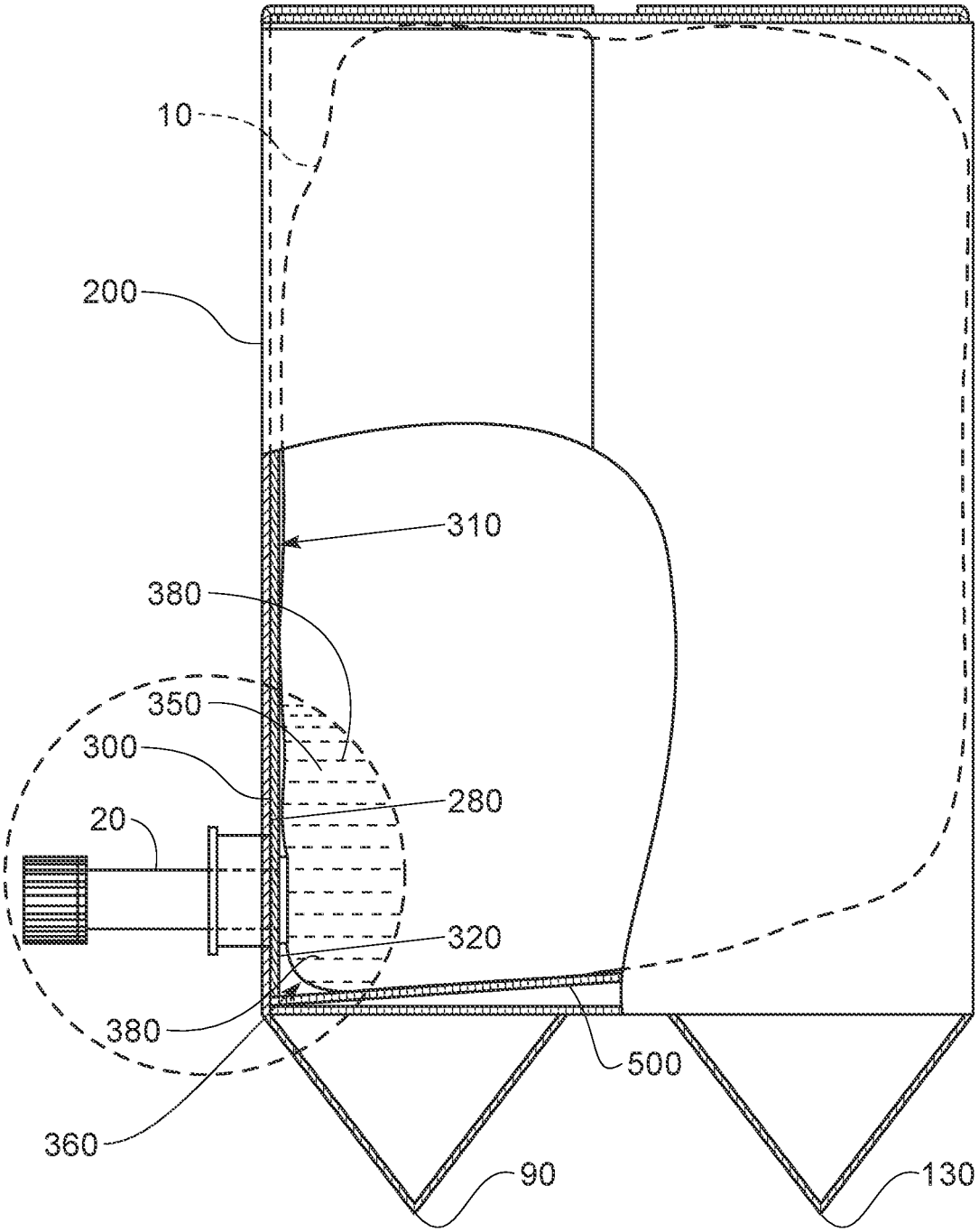
FIG. 15 is a partial side view.

The tap dispenser 20 can be engaged with a flexible bag 350 housed in the interior space 360, by way of nonlimiting example as shown in FIG. 15. When the moveable bottom part 320 is in the first position, the moveable bottom part 320 is pushed back into the interior space 360. The tap dispenser 20 and optional dose cup 30 are also in the interior space 360 when the moveable bottom part 320 is in the first position and the removeable tear strip 290 is engaged with the front panel 200. When the consumer removes the removeable tear strip 290, the static pressure of the liquid 380 contained in the flexible bag 350 can entirely drive or partially drive movement of the moveable bottom part 320 from the first position to the second position.

The bag in box container 10 can be provided with a ramp 500 in the interior space 360. The flexible bag 350 can sit on the ramp 500. The ramp 500 can guide liquid from within the flexible bag 350 to the tap dispenser 20. The ramp can be a separate piece of shaped plastic or corrugate cardboard 180 or paperboard fitted into the interior space 360. Optionally, the ramp 500 can be integral with one or more of any of the panels.

Figure 16:
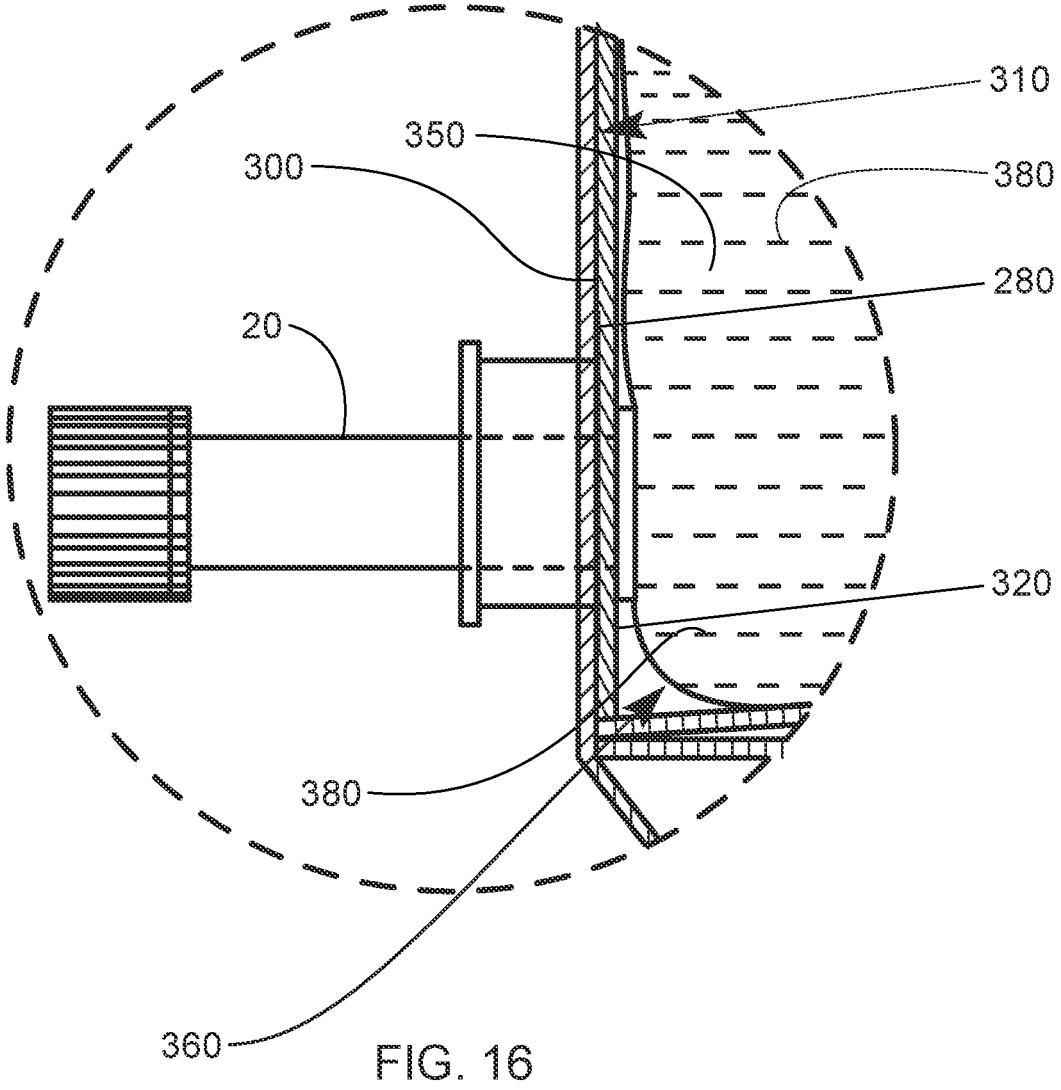
FIG. 16 is a part of partial side view.

A collar 370 can be engaged with the tap dispenser 20 and the moveable bottom part 320 can be seated between the collar 370 and the flexible bag 350, as shown in FIG. 16. Upon filling the flexible bag 350, the tap dispenser 20 can be fit to the flexible bag 350 or an appurtenance thereof. The tap dispenser can be fed through an opening or slot in the moveable bottom part 320 and the collar 370 can be fit to the tap dispenser 20 to pinch the moveable bottom part 320 between the collar 370 and the flexible bag 350 or appurtenance thereof.

Figure 17:
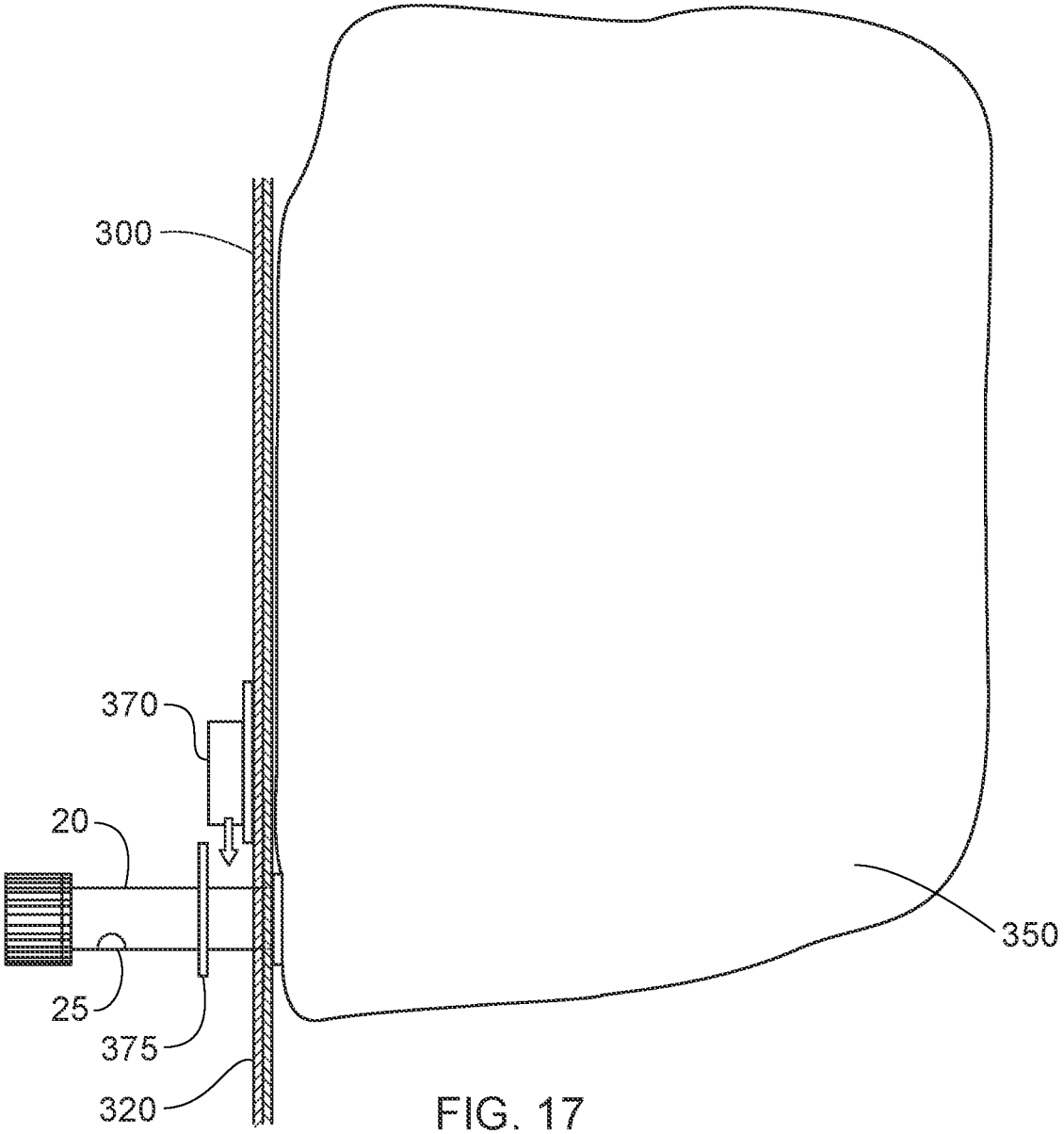
FIG. 17 is a part of a partial side view illustrating the collar being wedged in between the flange and the tap dispenser seating panel.
Figure 18:
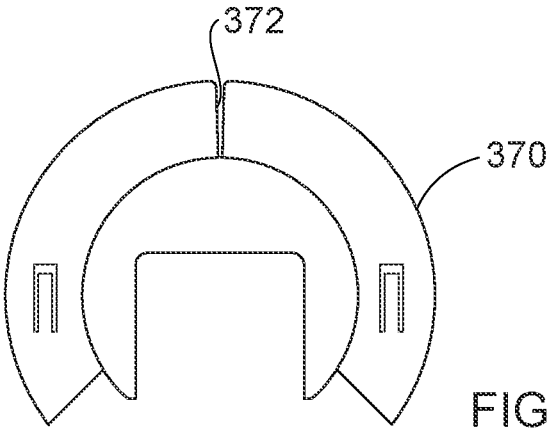
FIG. 18 is a collar.

The collar 370 can be slideably engaged between the moveable bottom part 320 and the tap dispenser flange 375. The tap dispenser flange 375 can be upstream of the tap dispenser opening. The collar 370 can wedge in between the tap dispenser flange 375 and the moveable bottom part 320, for example as shown in FIG. 17. The removable collar 370 can be practical for providing the consumer with an easy way to separate the flexible bag 350 and tap dispenser 20 from the remainder of the bag in box container 10 so that remainder can be collapsed and placed in the consumer's recycling bin, particularly if the remainder is constructed of paperboard or corrugate cardboard 180. A front view of a collar 370 is shown in FIG. 18. The collar 370 can include a recess 372 to increase the flexibility of the collar 370.

Figure 19:
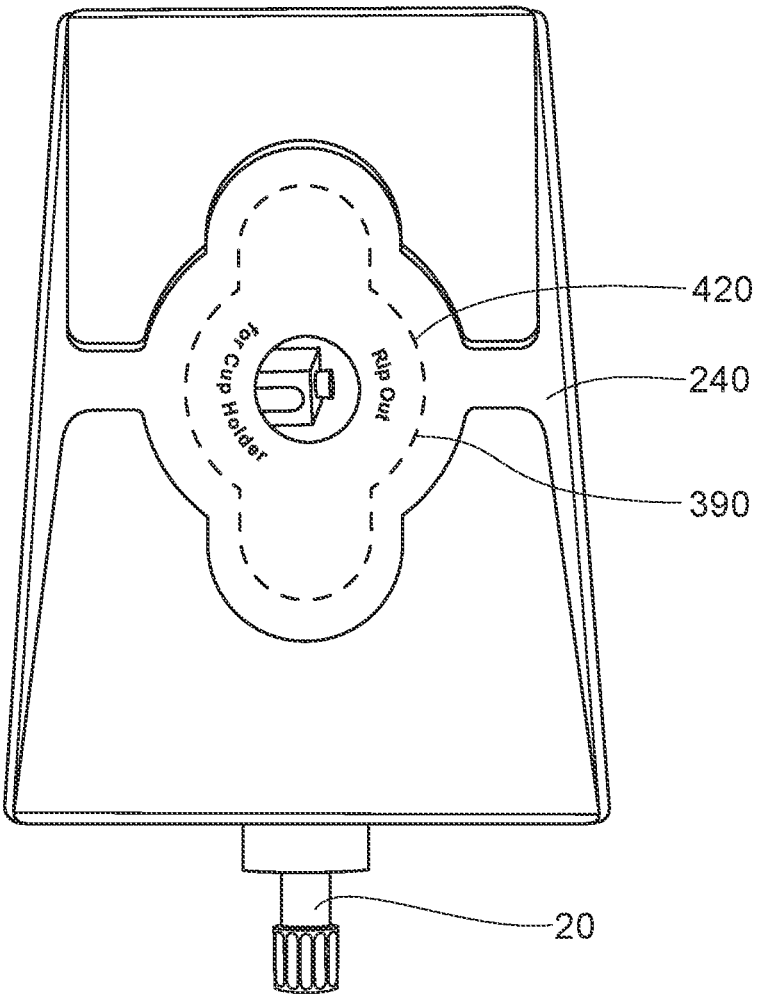
FIG. 19 is a top view, the predetermined removable portion is not removed.
Figure 20:
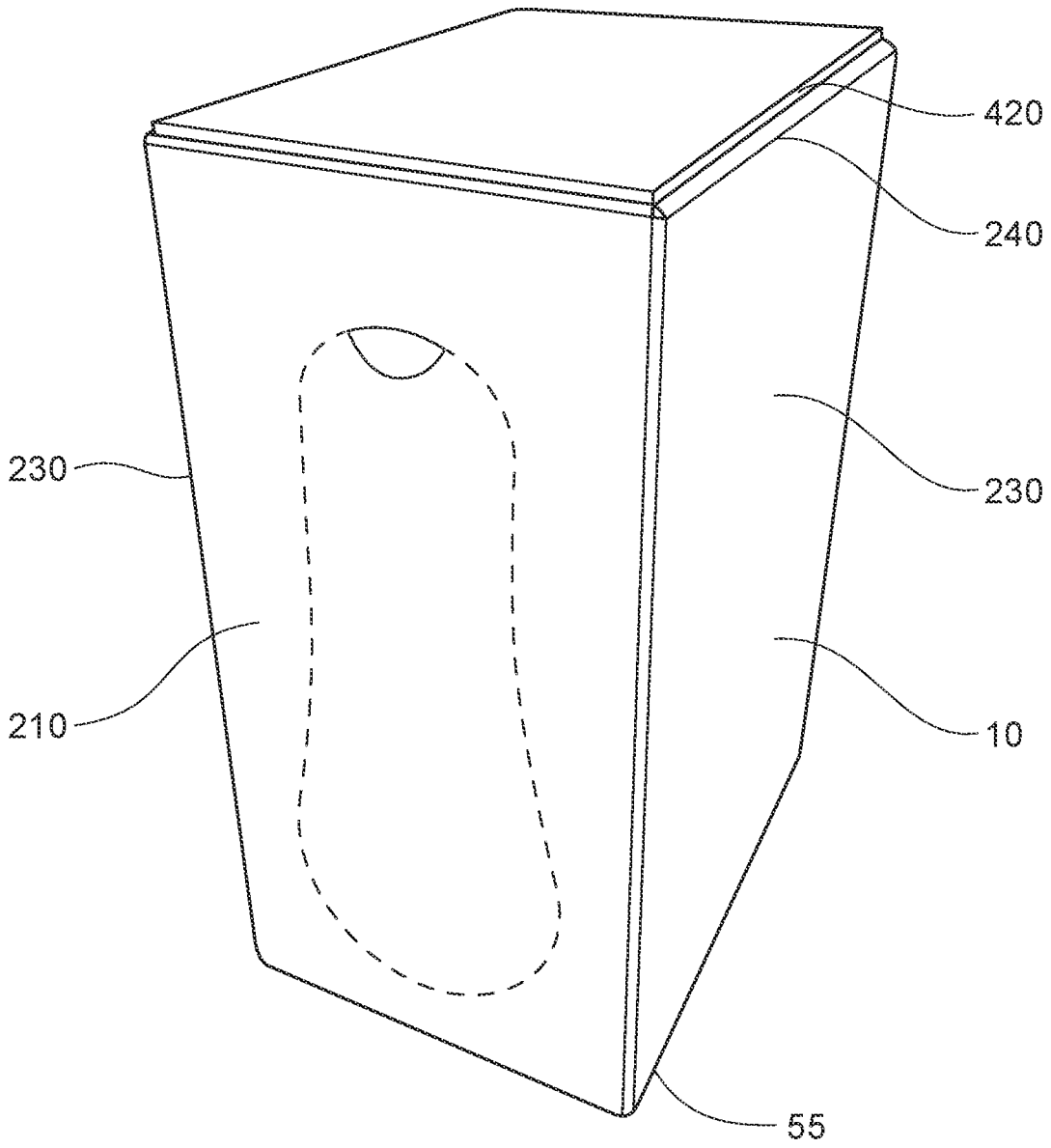
FIG. 20 is a perspective view, the predetermined removable portion is facing the top panel.

The bag in box container 10 can comprise a predetermined removeable portion 390 in or facing the top panel 240, by way of nonlimiting example as shown in FIG. 19. The predetermined removeable portion 390 can be bounded by a frangible boundary 420. Optionally, the predetermined removeable portion 390 can face the top panel 420, for example as shown in FIG. 20. The predetermined removeable portion 390 is considered to face the top panel 240 when, by way of nonlimiting example, when the predetermined removeable portion 390 is in direct contact with the top panel 240 or when there are one or more intermediate materials between the predetermined removeable portion 390 and the top panel 240 and the predetermined removeable portion 390 are in a substantially planar facing relationship. The predetermined removable portion 390 can sit loosely facing the top panel 240 or attached directly or indirectly to the top panel 240 with a releasable adhesive.

The predetermined removeable portion 390 can be removed to form the dosing cup holder opening or reveal a dosing cup holder opening that is provided in the top panel 240. The predetermined removable portion 390 overcomes the problem of shipping a bag in box container 10 with a cup holder opening. If the bag in box container has a large void as a cup holder opening, film wrap or shrink wrap or other outer packaging that covers the bag in box container 10 may be easily punctured in that area and possibly even the flexible bag 350 may be breached. Further, the void may be a weak region the bag in box container 10 that reduces the crush or drop strength of the bag in box container 10. The predetermined removeable portion 390 can protect the flexible bag 350 from being punctured.

Upon removing the bag in box container 10 from any outer packaging provided, the predetermined removable portion 390 can be removed from the top panel 240 or if the predetermined portion is not attached directly or indirectly to the top panel 240 the predetermined removable portion may fall away from the bag in box container 10. This can reveal or open the dosing cup holder opening. The predetermined removable portion 390 can be placed in a recycling basket if it is made of a pulp based material or optionally discarded.

Figure 21:
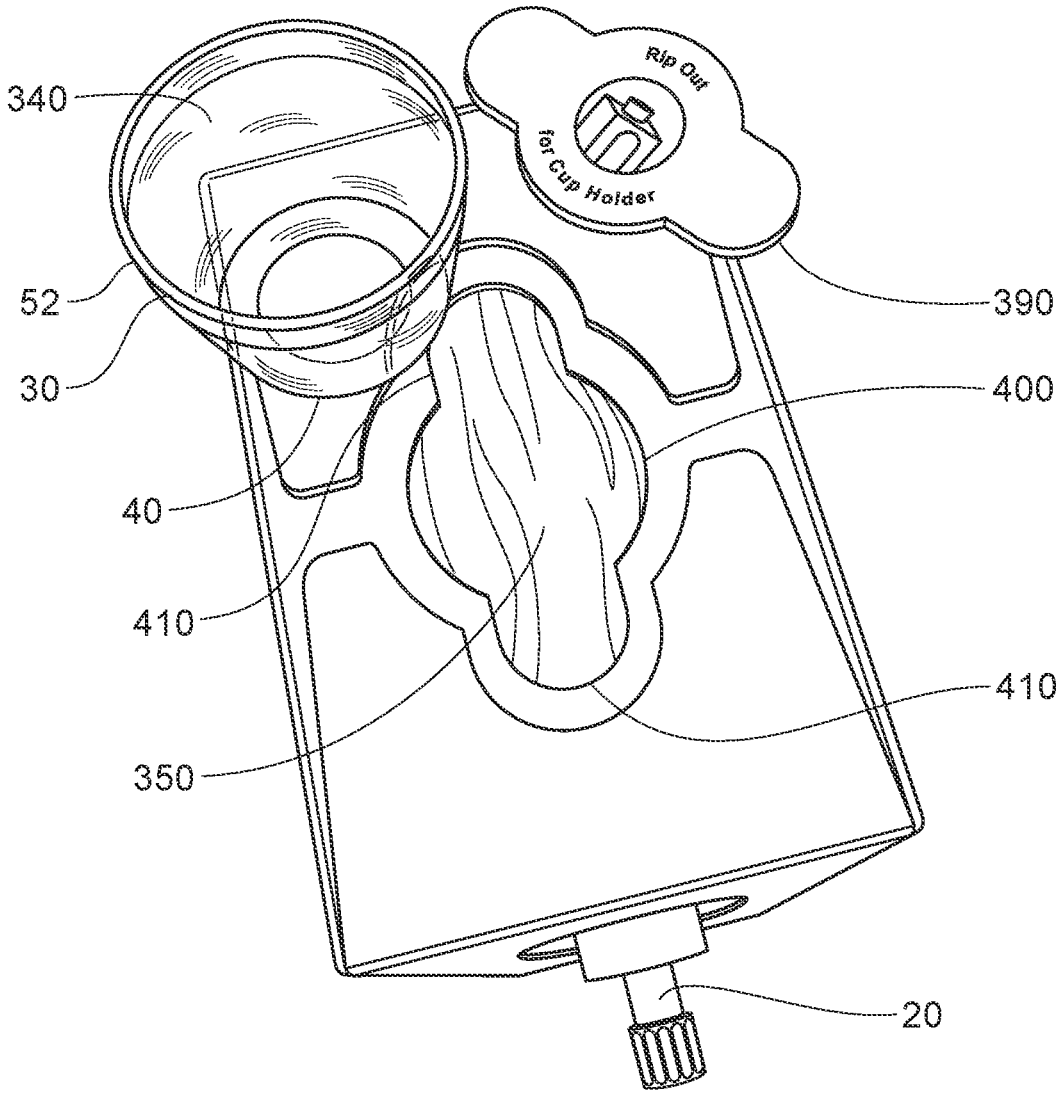
FIG. 21 is a top view, primarily showing the top of the bag in box container 10. The predetermined removable portion is removed.
Figure 22:
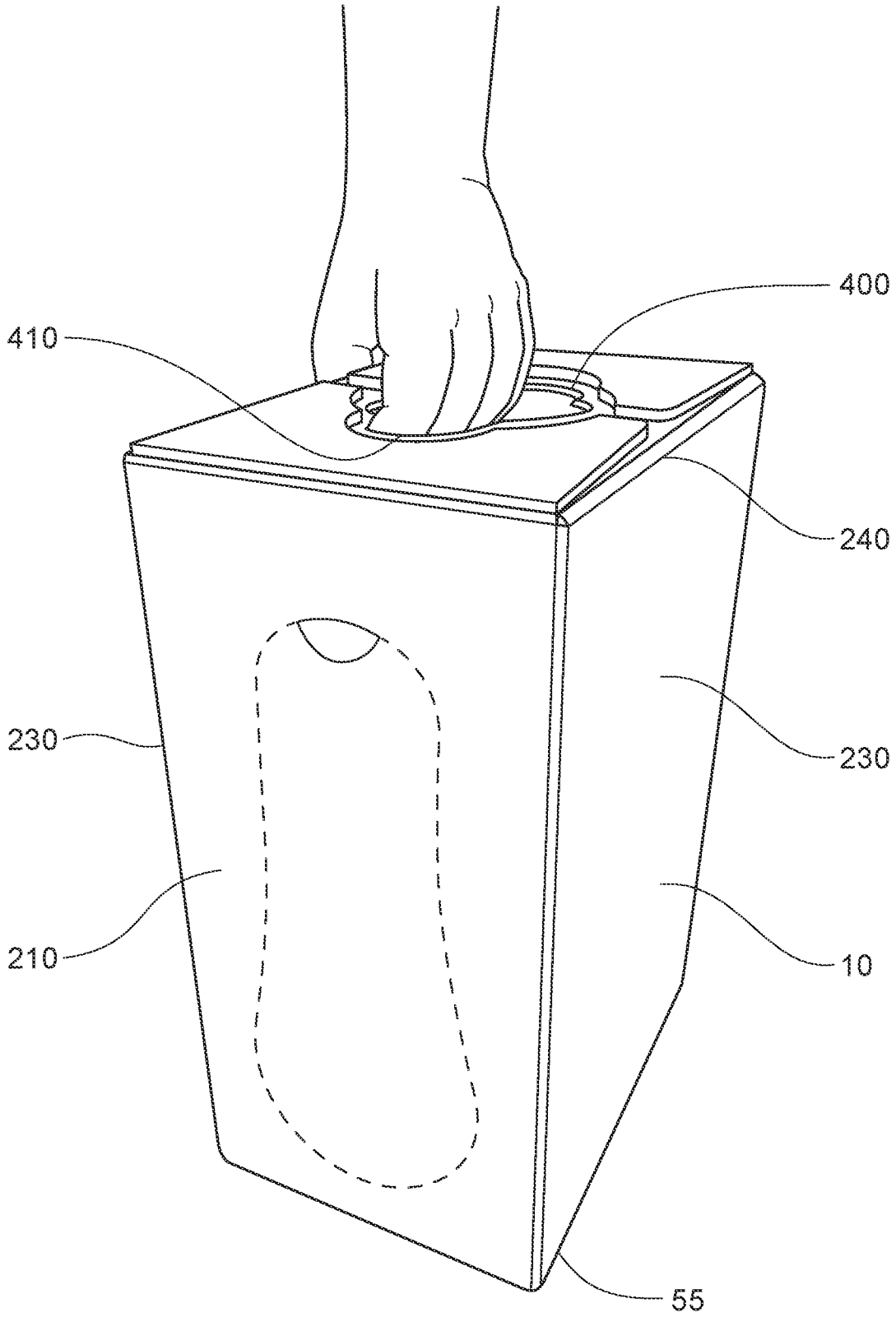
FIG. 22 illustrates how the bag in box container can be carried using the open axis.

The dosing cup holder opening 400 can comprise an open axis 410 sized and dimensioned to receive index, middle, ring, and little fingers of an individual adult human hand arranged in an extended side by side arrangement, by way of nonlimiting examples as shown in FIG. 21. The open axis 410 can extend from proximal the front panel 200 to proximal the rear panel 220. Optionally, the open axis 410 can extend between the side panels 230. The open axis 410 can provide a place into which the consumer puts his or her fingers to carry or lift the bag in box container 10. The open axis 410 is a lengthened open portion or open portion or portions of the dosing cup holder opening 400. A four finger grip with the fingers under the top panel and the thumb on the exterior of the bag in box container 10 can be an ergonomic gripping or carrying situation, for example as shown in FIG. 22.

Figure 23:
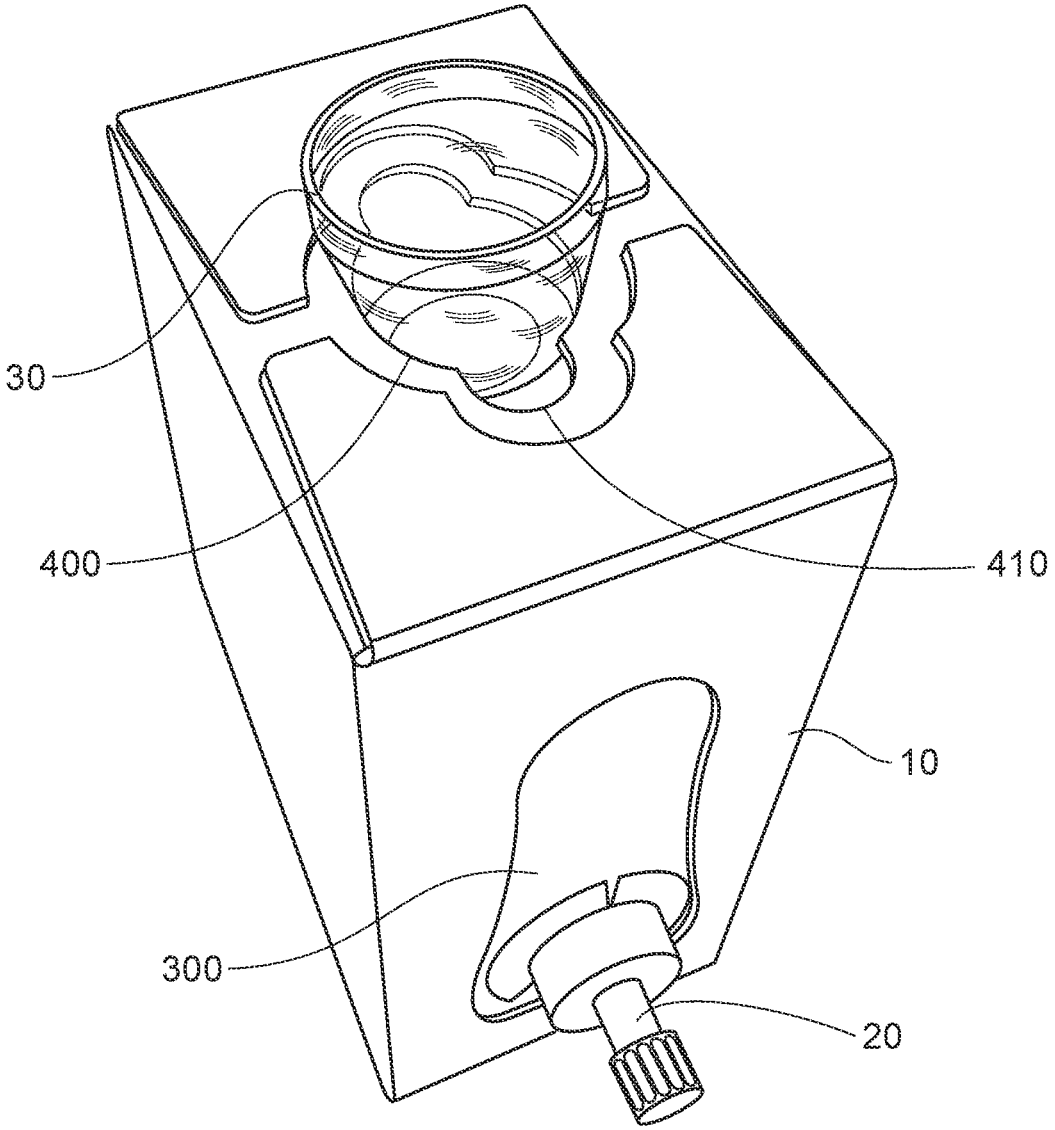
FIG. 23 is a perspective view with the dosing cup placed in the cup holder opening.

An arrangement in which the dosing cup 30 is seated in the dosing cup holder opening 400 is shown in FIG. 23. The dosing cup holder opening 400 can be sized and dimensioned to hold the dosing cup 30 and the open axis 410 can be sized and dimensioned such that the dosing cup closed end 40 can fit through the dosing cup holder opening 400 and the open end 52 cannot fit through the dosing cup holder opening 400 or the open axis 410.

The dosing cup holder opening 400 can provide the consumer with a convenient place to store the dosing cup 30 when not in use. Further, when all of the liquid is dispensed from the flexible bag 350, the consumer can remove the collar 370 to unseat the tap dispenser 20 and reach through the open axis 410 into the interior space 360 and pull the flexible bag 350 out of the interior space 360 and through the open axis 410 and cup holder opening 400. The box portion of the bag in box container 10 can then be placed into the consumers recycling basket.

The bag in box container 10 described herein has features that can provide for an enjoyable user experience. The dosing cup 30 can be provided interior to the bag in box container 10, which simplifies shipping of the product. The removable tear strip 290 can provide for easy access to the tap dispenser 20 and dosing cup 30. The tap dispenser seating panel 300 can provide for a tap dispenser 20 that sets itself into a position ready for use. The leg flaps can be erected to lift the bag in box container 10 above the surface upon which the bag in box container 10 rests so that the dosing cup 30 can easily be positioned beneath the tap dispenser 20. And the dosing cup holder opening 400 can be closed off during shipment so that the bag in box container 10 is solid on all sides and has sufficient strength to endure shipping without damage and then once removed, provides for a convenient location to store the dosing cup 30 and can have an open axis 410 that provides for a convenient gripping or carrying location.

Figure 24:
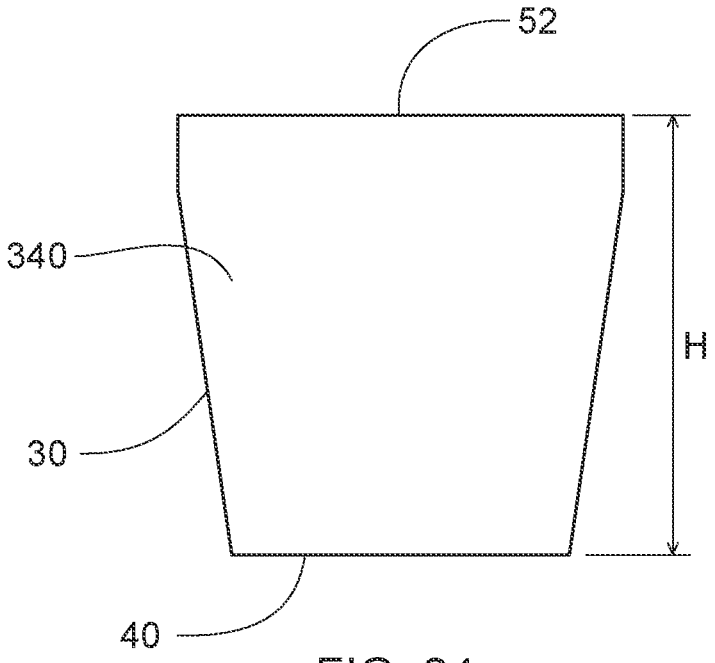
FIG. 24 is side view of a dosing cup.

A non-limiting example of a dosing cup 30 is shown in FIG. 24. The dosing cup 30 can be a plastic cup or other suitable material that can be fabricated or molded. The dosing cup 30 can be generally frusto-conically shaped. Dosing cup 30 can have one or more dosing indicia such as lines or bars indicative of volume.

Figure 25:
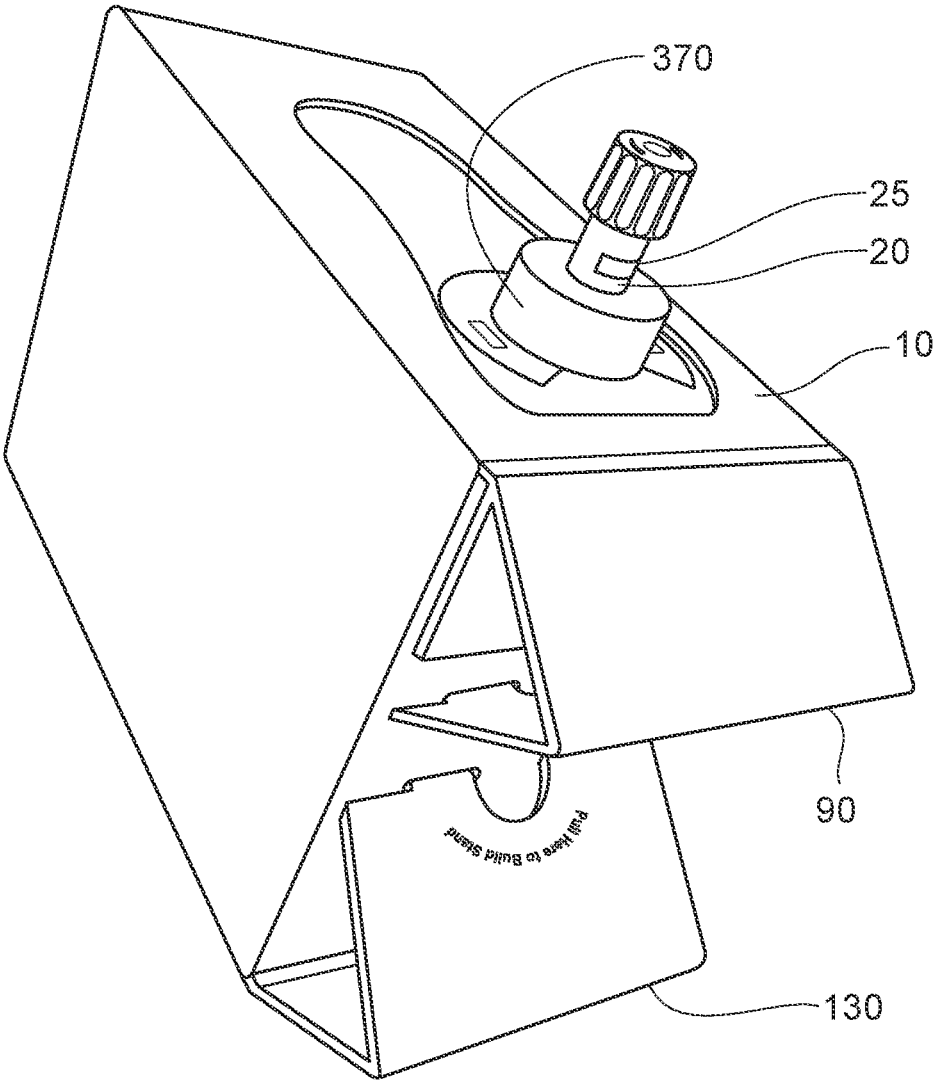
FIG. 25 is perspective view. The first leg flap is bent about the first hinge line and the second distal flap is bent about the second hinge line and the first distal end is engaged with the first discontinuity and the second distal end is engaged with the second discontinuity. The bag in box container is resting on a side panel.

FIG. 25 shows the bottom of a bag in box container 10 resting on a side panel 230 with the legs erected. The tap dispenser outlet 25 is downwardly oriented when the bag in box container 10 is in an in-use position. In an in-use position, the tap dispenser outlet 25 is elevated relative to the first hinge line 90 and the second hinge line 130.

The tap dispenser 20 can be a TURN TAP available from Vitop Moulding Srl, Alessandria, Italy. The flexible bag 350 can be a multi-layer film, metalized polyester, EVOH, or polyethylene bag (LLPDE, MLDPE, HDPE), nylon LLDPE laminate or coextrusion, foil laminate or other suitable material from which when formed into a bag from which liquid can freely drain there from when the tap dispenser 20 is opened.

Figure 26:
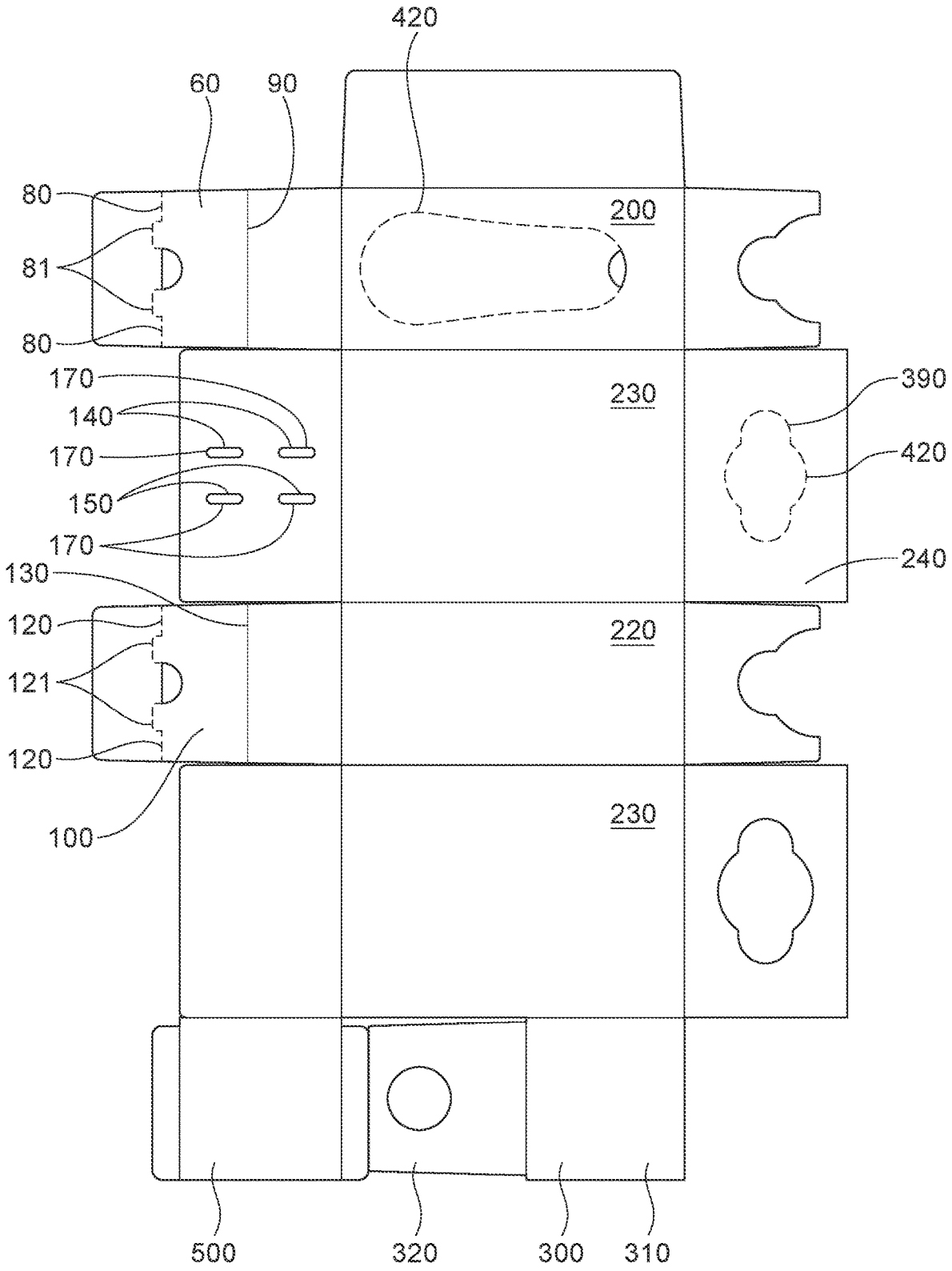
FIG. 26 is a blank from which the bag in box container may be erected.

A blank 510 from which the bag in box container 10 can be erected is shown in FIG. 26. The blank 510 can be folded in the desired locations and various portions tucked into position and connected to one another with glue. The features described herein can be set out on the blank as shown. Other arrangements are possible with due consideration to how the bag in box container 10 will be erected, especially if a machine or robot will be employed for such task.

A bag in box container 10 is disclosed herein. The bag in box container 10 can comprise: a tap dispenser 20 engaged with the bag in box container; a dosing cup 30 engaged with the bag in box container, the dosing cup 30 extending from a closed end 40 to an open end 52 and having a maximum height H between the closed end 40 and the open end 52, the maximum height H measured orthogonal to the closed end 40; and a bottom panel 50 elevationally below the tap dispenser 20 when the tap dispenser 20 is in an operable position. The dosing cup 30 can be contained in the interior space 360 of the bag in box container 10. The dosing cup 30 can be a plastic cup having a volume from about 10 mL to about 300 mL, optionally from about 30 mL to about 150 mL. The maximum height H of the dosing cup can be from about 20 mm to about 200 mm, optionally from about 30 mm to about 80 mm. The bottom panel 50 can be constructed of corrugated cardboard 180. Likewise, any of the panels described herein can be constructed of corrugated cardboard 180.

The bag in box container 10 can further comprise: a first leg flap 60 positioned elevationally below the bottom panel 50, the first leg flap 60 extending from a first proximal end 70 associated with the bag in box container 10 to a first distal end 80 and having a first hinge line 90 positioned between the first proximal end 70 and the first distal end 80.

The bag in box container 10 can further comprise: a second leg flap 100 positioned elevationally below the bottom panel 50, the second leg flap 100 extending from a second proximal end 110 associated with the bag in box container 10 to a second distal end 120 and having a second hinge line 130 positioned between the second proximal end 110 and the second distal end 120.

The first hinge line 90 and the second hinge line 130 can be a crease 190 or a perforated line.

The first leg flap 60 can be integral with, joined to, or extend from the front panel 200. The second leg flap 100 can be integral with or extend from the rear panel 220. Optionally the proximal ends of the first leg flap 60 and the second leg flap 100 can be integral with, joined to, or extend from the bottom panel 50.

The bag in box container 10 can further comprise a first discontinuity 140 in the bottom panel 50 positioned between the first hinge line 90 and the first distal end 80 and operably engageable with the first distal end 80 when the first leg flap 60 is folded about the first hinge line 90.

The bag in box container 10 can further comprise a second discontinuity 150 in the bottom panel 50 positioned between the second hinge line 130 and the second distal end 120 and operably engageable with the second distal end 120 when the second leg flap 100 is folded about the second hinge line 130.

The first discontinuity 140 and second discontinuity 150 can be slits in the bottom panel. A slit is a cut made without removing material. The first discontinuity 140 and second discontinuity 150 can be slots in the bottom panel. A slot is a cut made by removing material. The first discontinuity 140 and second discontinuity 150 can be divots or recessed portions in the bottom panel. A divot or recess can be made by compressing the material.

When the first distal end 80 is engaged with the first discontinuity 140 and the second distal end 120 is engaged with the second discontinuity 150 a resting plane 160 defined by the hinge lines is separated from the tap dispenser outlet 25 by a distance greater than the maximum height H. Such an arrangement can make it easy to place a dosing cup 30 beneath the tap dispenser outlet 25 so that the liquid can be dispensed into the dosing cup 30.

The resting plane 160 can be separated from the tap dispenser outlet by a distance of more than about 110% of the maximum height H. The resting plane 160 can be separated from the tap dispenser outlet by a distance ranging from about 110% of the maximum height H to about 200% of the maximum height H. The resting plane 160 can be separated from the tap dispenser outlet by a distance ranging from about 110% of the maximum height H to about 170% of the maximum height H.

The first discontinuity 140 and the second discontinuity 150 can be a structure selected from the group consisting of a slot (170), a slit, and combinations thereof.

There can be a plurality of first discontinuities 140 and a plurality of second discontinuities 150.

The bottom panel 50, the first leg flap 60, and the second leg flap 100 can be corrugate cardboard 180.

The bottom panel 50, the first leg flap 60, and the second leg flap 100 can be integral with one another. Integral means that structure between two elements is continuous as opposed to separate pieces being attached to one another.

The bag in box container 10 can contain liquid laundry detergent. The bag in box container 10 can contain liquid fabric softener. The bag in box container 10 can contain wine. The bag in box container 10 can contain distilled alcohol.

The bag in box container 10 can be described as comprising a front panel 200 which is a dispensing side 210 of the bag in box container 10, a rear panel 220 opposite the front panel 200, opposing side panels 230 connecting the front panel 200 to the rear panel 220, and a top panel 240 opposite the bottom panel 50.

The process for deploying the bag in box container 10 as described herein can comprise the steps of: folding the first leg flap 60 about the first hinge line 90 and engaging the first distal end 80 with the first discontinuity 140; folding the second leg flap 100 about the second hinge line 130 and engaging the second distal end 120 with the second discontinuity 150; and positioning the bag in box container 10 to stand on the first hinge line 90 and the second hinge line 130 to elevate the tap dispenser 20. The bag in box container 10 can comprise: a tap dispenser 20 engaged with the bag in box container 10; a front panel 200 that is a dispensing side 210 of the bag in box container 10, a rear panel 220 opposite the front panel 200, opposing side panels 230 connecting the front panel 200 to the rear panel 220, a bottom panel 50 below the tap dispenser 20, and a top panel 240 opposite the bottom panel 50, wherein the front panel 200 has a front panel exterior facing surface 270 and an opposing front panel interior facing surface 280; a removable tear strip 290 in the front panel 200 can at least partially cover the tap dispenser 20; a tap dispenser seating panel 300 having an upper part 310, optionally proximal to the top panel 240, facing the front panel 200 and movable bottom part 320 with which the tap dispenser 20 is engaged, wherein the movable bottom part 320 has a first position away from the front panel interior facing surface 280 and a second position facing the front panel interior facing surface 280 when the removable tear strip 290 is separated from the front panel 200. The removable tear strip 290 can provide convenient access to the tap dispenser 20, and optional dosing cup 30, housed inside the bag in box container 10. The consumer removes the removable tear strip 290 to access these parts. The tear strip 290 can be bounded by a frangible boundary 420.

When the movable bottom part 320 is in the second position the tap dispenser 20 projects beyond the front panel exterior facing surface 270 though an opening 330 defined by the removable tear strip 290. In this position, the tap dispenser 20 can be used to dispense liquid.

A dosing cup 30 can optionally be housed in an interior space 360 of the bag in box container 10 defined by the front panel 200, the rear panel 220, the side panels 230, the top panel 240 and the bottom panel 50. Providing a dosing cup 30 interior to the bag in box container 10 is convenient for the consumer since he or she does not have to acquire one from some other source. Further, the dosing cup 30 is protected during shipment.

The tap dispenser 20 can be engaged with a flexible bag 350 housed in an interior space 360 of the bag in box container 10 defined by the front panel 200, the rear panel 220, the side panels 230, the top panel 240 and the bottom panel 50, optionally wherein the flexible bag 350 contains liquid laundry detergent or liquid fabric softener.

To securely engage the tap dispenser 20 with the movable bottom part 320, a collar 370 can be engaged with the tap dispenser 20 and the moveable bottom part 320 is between the collar 370 and a flexible bag 350 housed in an interior space 360 of the bag in box container The upper part 310 can be engaged with a panel selected from the group consisting of the top panel 240, one or both of the side panels 230, the front panel 200, and combinations thereof. The upper part 310 can be integral with a panel selected from the group consisting of the top panel 240, one or both of the side panels 230, the front panel 200, and combinations thereof.

The bag in box 10 can be provided with the removable tear strip 290 and associated parts along with the leg flaps described above.

The bag in box container 10 can be deployed by a process comprising the steps of: orienting the bottom panel 50 such that the top panel 240 is positioned above the bottom panel 50; removing the removable tear strip 290 from the front panel 200; and moving the moveable bottom part 320 from the first position to the second position.

The tap dispenser 20 can be engaged with a flexible bag 350 housed in an interior space 360 of the bag in box container defined by the front panel 200, the rear panel 220, the side panels 230, the top panel 240 and the bottom panel 50, optionally wherein the flexible bag 350 contains liquid laundry detergent or liquid fabric softener, wherein the flexible bag 350 contains a liquid 380 and the step of moving the moveable bottom part 320 from the first position to the second position is at least partially driven or entirely driven by static pressure of the liquid 380. When the consumer removes the removable tear strip 290, the tap dispenser 20, and optionally the dosing cup 30 if provided, are pushed by the static pressure out of the opening 330 formed by the removal of the removable tear strip 290.

The bag in box container 10 can comprise: a tap dispenser 20 engaged with the bag in box container 10; a front panel 200 that is a dispensing side 210 of the bag in box container 10, a rear panel 220 opposite the front panel 200, opposing side panels 230 connecting the front panel 200 to the rear panel 220, a bottom panel 50 below the tap dispenser 20, and a top panel 240 opposite the bottom panel 50, wherein the front panel 200, the rear panel 220, the side panels 230, the top panel 240, and the bottom panel 50 define an interior space 360; a dosing cup 30 can be housed in the interior space 360, wherein the dosing cup 30 comprises a closed end 40 and an open end 52 and a peripheral wall 340 extending from the closed end 40 to the open end 52; a predetermined removable portion 390 can be in the top panel 240, wherein the predetermined removable portion 390 is sized and dimensioned such that when the predetermined removable portion 390 is removed to open a dosing cup holder opening 400 the closed end 40 can pass through the dosing cup holder opening 400 and into the interior space 360 and the open end 52 is exterior to the bag in box container 10 when the dosing cup 30 is seated in the dosing cup holder opening 400.

The dosing cup holder opening 400 can comprise an open axis 410 sized and dimensioned to receive index, middle, ring, and little fingers of an individual adult human hand arranged in an extended side by side relationship. This can make it convenient for a consumer to carry the bag in box container 10. The open axis 410 can extend from proximal the front panel 200 to proximal the rear panel 220. This can be convenient if the front panel 200 is relatively narrow and the side panels 230 are deeper than the width of the front panel 200.

The dosing cup holder opening 400 can be formed by removing the predetermined removable portion 390. Optionally the predetermined removeable portion 390 can cover the dosing cup holder opening 400. The predetermined removeable portion 390 can be bounded by a frangible boundary 420.

When the bag in box container 10 is in operable position the tap dispenser 30 can be above the bottom panel 50 and the top panel 240 can be above the bottom panel 50.

The bag in box container 10 can be deployed by a process comprising the steps of: removing the dosing cup 30 from the interior space 360; removing the predetermined removable portion 390 from the top panel 240; placing the closed end 40 of the dosing cup 30 into the dosing cup holder opening so that the dosing cup 30 is held by the dosing cup holder opening 400.

Combinations

A. A bag in box container (10) comprising:

a tap dispenser (20) engaged with said bag in box container, wherein said tap dispenser has a tap dispenser outlet (25) through which flow can occur;

a dosing cup (30) engaged with said bag in box container, said dosing cup extending from a closed end (40) to an open end (52) and having a maximum height (H) between said closed end and said open end, said maximum height measured orthogonal to said closed end;

a bottom panel (50) elevationally below said tap dispenser when said tap dispenser is in an operable position;

a first leg flap (60) positioned elevationally below said bottom panel, said first leg flap extending from a first proximal end (70) associated with said bag in box container to a first distal end (80) and having a first hinge line (90) positioned between said first proximal end and said first distal end;

a second leg flap (100) positioned elevationally below said bottom panel, said second leg flap extending from a second proximal end (110) associated with said bag in box container to a second distal end (120) and having a second hinge line (130) positioned between said second proximal end and said second distal end;

a first discontinuity (140) in said bottom panel positioned between said first hinge line and said first distal end and operably engageable with said first distal end when said first leg flap is folded about said first hinge line;

a second discontinuity (150) in said bottom panel positioned between said second hinge line and said second distal end and operably engageable with said second distal end when said second leg flap is folded about said second hinge line;

wherein, when said first distal end is engaged with said first discontinuity and said second distal end is engaged with said second discontinuity a resting plane (160) defined by said hinge lines is separated from said tap dispenser outlet by a distance greater than said maximum height.

B. The bag in box container according to Paragraph A, wherein said first discontinuity and said second discontinuity are a structure selected from the group consisting of a slot (170), a slit (172), and combinations thereof.

C. The bag in box container according to Paragraph A or B, wherein said bottom panel, said first leg flap, and said second leg flap are corrugate cardboard (180).

D. The bag in box container according to any of Paragraphs A to C, wherein said bottom panel, said first leg flap, and said second leg flap are integral with one another.

E. The bag in box container according to any of Paragraphs A to D, wherein said first hinge line and said second hinge line is a crease line (190) or a perforated line (192).

F. The bag in box container according to any of Paragraphs A to E, wherein said resting plane is separated from said tap dispenser outlet by a distance ranging from about 110% of said maximum height to about 200% of said maximum height.

G. The bag in box container according to any of Paragraphs A to F, wherein said resting plane is separated from said tap dispenser outlet by a distance ranging from about 110% of said maximum height to about 170% of said maximum height.

H. The bag in box container according to any of Paragraphs A to G, wherein said bag in box container contains liquid laundry detergent or liquid fabric softener.

I. The bag in box container according to any of Paragraphs A to H, wherein said bag in box container comprises a front panel (200) which is a dispensing side (210) of said bag in box container, a rear panel (220) opposite said front panel, opposing side panels (230) connecting said front panel to said rear panel, and a top panel (240) opposite said bottom panel.

J. The bag in box container according to Claim I, wherein said first leg flap extends from said front panel and said second leg flap extends from said rear panel.

K. The bag in box container according to Paragraph I or J, wherein said bottom panel extends from one of said side panels.

L. The bag in box container according to any of Paragraphs I to K, wherein said bottom panel, said first leg flap, and said second leg flap are corrugate cardboard (180) and said corrugate cardboard comprises flutes (182) between two layers of paperboard (184) and said first hinge line and said second hinge line are aligned with said flutes.

M. The bag in box container according to any of Paragraphs A to L, wherein said tap dispenser has an installed position that projects beyond said bottom panel and in said installed position said tap dispenser outlet is more than about 110%, optionally from about 110% to about 200%, of said maximum height above said resting plane.

N. A process for deploying the bag in box container of any of Paragraphs A to I comprising the steps of:

folding said first leg flap about said first hinge line and engaging said first distal end with said first discontinuity;

folding the second leg flap about said second hinge line and engaging said second distal end with said second discontinuity; and positioning said bag in box container to stand on said first hinge line and said second hinge line to elevate said tap dispenser.

O. A process for deploying the bag in box container of any of Paragraphs J to M comprising the steps of:

folding said first leg flap about said first hinge line and engaging said first distal end with said first discontinuity;

folding said second leg flap about said second hinge line and engaging said second distal end with said second discontinuity; and positioning said bag in box container to stand on said first hinge line and said second hinge line to elevate said tap dispenser.

P. A bag in box container (10) comprising:

a tap dispenser (20) engaged with said bag in box container, wherein said tap dispenser has a tap dispenser outlet (25) through which flow can occur;

a dosing cup (30) engaged with said bag in box container, said dosing cup extending from a closed end (40) to an open end (52) and having a maximum height (H) between said closed end and said open end, said maximum height measured orthogonal to said closed end;

a bottom panel (50) elevationally below said tap dispenser when said tap dispenser is in an operable position;

a first leg flap (60) positioned elevationally below said bottom panel, said first leg flap extending from a first proximal end (70) associated with said bag in box container to a first distal end (80) and having a first hinge line (90) positioned between said first proximal end and said first distal end;

a second leg flap (100) positioned elevationally below said bottom panel, said second leg flap extending from a second proximal end (110) associated with said bag in box container to a second distal end (120) and having a second hinge line (130) positioned between said second proximal end and said second distal end;

a first discontinuity (140) in said bottom panel positioned between said first hinge line and said first distal end and operably engageable with said first distal end when said first leg flap is folded about said first hinge line;

a second discontinuity (150) in said bottom panel positioned between said second hinge line and said second distal end and operably engageable with said second distal end when said second leg flap is folded about said second hinge line.

Q. The bag in box container according to Paragraph P, wherein when said first distal end is engaged with said first discontinuity and said second distal end is engaged with said second discontinuity said bottom panel is spaced apart from said first hinge line and said second hinge line by an equal distance.

R. The bag in box container (10) according to Paragraph P:

wherein said first leg flap comprises a first tab (81) extending from said first distal end;

wherein said first hinge line is a distance L1 from said first proximal end;

wherein said first distal end is a distance L2 from said first hinge line;

wherein said first discontinuity is a distance L3 from said first distal end;

wherein said first leg flap has a first lift height H1;

wherein L3 is greater than or equal to $L1+L2-(L1^2-H1^2)^{1/2}-(L2^2-H1^2)^{1/2}$ and said first discontinuity is located at a distance L1+L2−L3 from said first proximal end;

wherein said second leg flap comprises a second tab (121) extending from said second distal end;

wherein said second hinge line is a distance L4 from said second proximal end;

wherein said second distal end is a distance L5 from said second hinge line;

wherein said second discontinuity is a distance L6 from said second distal end;

wherein said second leg flap has a second lift height H2;

wherein L6 is greater than or equal to $L4+L5-(L4^2-H2^2)^{1/2}-(L5^2-H2^2)^{1/2}$ and said second discontinuity is located at a distance L4+L5−L6 from said second proximal end;

wherein H1 and H2 are equal and greater than 50% of said maximum height;

wherein said first tab is sized and dimensioned to fit into said first discontinuity;

wherein said second tab is sized and dimensioned to fit into said second discontinuity;

wherein $L1^2$ is greater than $H1^2$ and $L4^2$ is greater than $H2^2$.

S. The bag in box container according to Paragraph R, wherein L1 and L4 are equal.

T. The bag in box container according to any of Paragraphs A to M and P to S, wherein, when said first distal end is engaged with said first discontinuity and said second distal end is engaged with said second discontinuity said first hinge line and said second hinge line both lie a resting plane (160) that extends to beneath said tap dispenser and said tap dispenser outlet is more than 100% of said maximum height above said resting plane.

U. The bag in box container according to any of Paragraphs A to M and P to T, wherein said resting plane is separated from said tap dispenser outlet by a distance of more than about 110% of said maximum height.

V. The bag in box container according to any of Paragraphs A to M and P to U, wherein said tap dispenser outlet is more than about 110% of said maximum height above said resting plane.

W. The bag in box container according to any of Paragraphs A to M and P to V, wherein said tap dispenser outlet is from about 110% to about 200% of said maximum height above said resting plane.

X. The bag in box container according to any of Paragraphs A to M and P to W, wherein said tap dispenser outlet is from about 110% to about 170% of said maximum height above said resting plane.

Y. The bag in box container according to any of any of Paragraphs A to M and P to X, wherein at least one of said first discontinuity and said second discontinuity comprise a recess.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A bag in box container comprising:

a tap dispenser engaged with said bag in box container, wherein said tap dispenser has a tap dispenser outlet through which flow can occur;

a dosing cup engaged with said bag in box container, said dosing cup extending from a closed end to an open end and having a maximum height between said closed end and said open end, said maximum height measured orthogonal to said closed end;

a bottom panel elevationally below said tap dispenser when said tap dispenser is in an operable position;

a first leg flap positioned elevationally below said bottom panel, said first leg flap extending from a first proximal end associated with said bag in box container to a first distal end and having a first hinge line positioned between said first proximal end and said first distal end;

a second leg flap positioned elevationally below said bottom panel, said second leg flap extending from a second proximal end associated with said bag in box container to a second distal end and having a second hinge line positioned between said second proximal end and said second distal end;

a first discontinuity in said bottom panel positioned between said first hinge line and said first distal end and operably engageable with said first distal end when said first leg flap is folded about said first hinge line; and a second discontinuity in said bottom panel positioned between said second hinge line and said second distal end and operably engageable with said second distal end when said second leg flap is folded about said second hinge line;

wherein when said first distal end is engaged with said first discontinuity and said second distal end is engaged with said second discontinuity, a resting plane defined by said hinge lines is separated from said tap dispenser outlet by a distance greater than said maximum height;

wherein said bag in box container comprises a front panel which is a dispensing side of said bag in box container, a rear panel opposite said front panel, opposing side panels between said front panel and said rear panel, and a top panel opposite said bottom panel, wherein said tap dispenser projects beyond said front panel exterior facing surface; and wherein said bottom panel, said first leg flap, and said second leg flap are corrugate cardboard and said corrugate cardboard comprises flutes between two layers of paperboard and said first hinge line and said second hinge line are aligned with said flutes.

2. The bag in box container according to claim 1, wherein said first discontinuity and said second discontinuity are a structure selected from the group consisting of a slot, a slit, and combinations thereof.

3. The bag in box container according to claim 2, wherein said bottom panel, said first leg flap, and said second leg flap are integral with one another.

4. The bag in box container according to claim 1, wherein said first hinge line and said second hinge line is a crease line or a perforated line.

5. The bag in box container according to claim 1, wherein said resting plane is separated from said tap dispenser outlet by a distance ranging from 110% of said maximum height to 200% of said maximum height.

6. The bag in box container according to claim 1, wherein said bag in box container contains liquid laundry detergent or liquid fabric softener.

7. The bag in box container according to claim 6, wherein said first leg flap extends from said front panel and said second leg flap extends from said rear panel.

8. A process for deploying the bag in box container of claim 7 comprising the steps of:

folding said first leg flap about said first hinge line and engaging said first distal end with said first discontinuity;

folding the second leg flap about said second hinge line and engaging said second distal end with said second discontinuity; and positioning said bag in box container to stand on said first hinge line and said second hinge line to elevate said tap dispenser.

9. The bag in box container according to claim 6, wherein said bottom panel extends from one of said side panels.

10. The bag in box container according to claim 1, wherein said tap dispenser has an installed position in said installed position said tap dispenser outlet is more than 110% of said maximum height above said resting plane.

11. A process for deploying the bag in box container of claim 1 comprising the steps of:

folding said first leg flap about said first hinge line and engaging said first distal end with said first discontinuity;

folding the second leg flap about said second hinge line and engaging said second distal end with said second discontinuity; and positioning said bag in box container to stand on said first hinge line and said second hinge line to elevate said tap dispenser.

12. A bag in box container comprising:

a tap dispenser engaged with said bag in box container, wherein said tap dispenser has a tap dispenser outlet through which flow can occur;

a dosing cup engaged with said bag in box container, said dosing cup extending from a closed end to an open end and having a maximum height between said closed end and said open end, said maximum height measured orthogonal to said closed end;

a bottom panel elevationally below said tap dispenser when said tap dispenser is in an operable position;

a first leg flap positioned elevationally below said bottom panel, said first leg flap extending from a first proximal end associated with said bag in box container to a first distal end and having a first hinge line positioned between said first proximal end and said first distal end;

a second leg flap positioned elevationally below said bottom panel, said second leg flap extending from a second proximal end associated with said bag in box container to a second distal end and having a second hinge line positioned between said second proximal end and said second distal end;

a first discontinuity in said bottom panel positioned between said first hinge line and said first distal end and operably engageable with said first distal end when said first leg flap is folded about said first hinge line; and a second discontinuity in said bottom panel positioned between said second hinge line and said second distal end and operably engageable with said second distal end when said second leg flap is folded about said second hinge line;

wherein when said first distal end is engaged with said first discontinuity and said second distal end is engaged with said second discontinuity, a resting plane defined by said hinge lines is separated from said tap dispenser outlet by a distance greater than said maximum height;

wherein said bag in box container comprises a front panel which is a dispensing side of said bag in box container, a rear panel opposite said front panel, opposing side panels connecting said front panel to said rear panel, and a top panel opposite said bottom panel;

wherein said first leg flap extends from said front panel and said second leg flap extends from said rear panel;

wherein said bottom panel extends from one of said side panels;

wherein said bottom panel, said first leg flap, and said second leg flap are corrugate cardboard and said corrugate cardboard comprises flutes between two layers of paperboard and said first hinge line and said second hinge line are aligned with said flutes; and wherein said tap dispenser has an installed position that projects through said front panel in said installed position said tap dispenser outlet is more than 110% of said maximum height above said resting plane.

13. A process for deploying the bag in box container of claim 12 comprising the steps of:

folding said first leg flap about said first hinge line and engaging said first distal end with said first discontinuity;

folding the second leg flap about said second hinge line and engaging said second distal end with said second discontinuity; and positioning said bag in box container to stand on said first hinge line and said second hinge line to elevate said tap dispenser.

14. A bag in box container comprising:

a tap dispenser engaged with said bag in box container, wherein said tap dispenser has a tap dispenser outlet through which flow can occur;

a dosing cup engaged with said bag in box container, said dosing cup extending from a closed end to an open end and having a maximum height between said closed end and said open end, said maximum height measured orthogonal to said closed end;

a bottom panel entirely elevationally below said tap dispenser when said tap dispenser is in an operable position;

a first leg flap positioned elevationally below said bottom panel, said first leg flap extending from a first proximal end associated with said bag in box container to a first distal end and having a first hinge line positioned between said first proximal end and said first distal end;

a second leg flap positioned elevationally below said bottom panel, said second leg flap extending from a second proximal end associated with said bag in box container to a second distal end and having a second hinge line positioned between said second proximal end and said second distal end;

a first discontinuity in said bottom panel positioned between said first hinge line and said first distal end and operably engageable with said first distal end when said first leg flap is folded about said first hinge line; and a second discontinuity in said bottom panel positioned between said second hinge line and said second distal end and operably engageable with said second distal end when said second leg flap is folded about said second hinge line;

wherein when said first distal end is engaged with said first discontinuity and said second distal end is engaged with said second discontinuity, a resting plane defined by said hinge lines is separated from said tap dispenser outlet by a distance greater than said maximum height; and wherein said bag in box container comprises a front panel which is a dispensing side of said bag in box container, a rear panel opposite said front panel, opposing side panels between said front panel and said rear panel, and a top panel opposite said bottom panel, wherein said tap dispenser projects beyond said front panel exterior facing surface.

15. The bag in box container according to claim 14, wherein said resting plane is separated from said tap dispenser outlet by a distance ranging from 110% of said maximum height to 200% of said maximum height.

16. The bag in box container according to claim 14, wherein said bottom panel, said first leg flap, and said second leg flap are corrugate cardboard and said corrugate cardboard comprises flutes between two layers of paperboard and said first hinge line and said second hinge line are parallel with said flutes.

* * * * *